US006513750B2

(12) United States Patent
Miller

(10) Patent No.: US 6,513,750 B2
(45) Date of Patent: Feb. 4, 2003

(54) LOCKOUT CAM FOR A BEDROLL OF A REWINDER

(75) Inventor: David C. Miller, Appleton, WI (US)

(73) Assignee: Paper Converting Machine Company, Green Bay, WI (US)

( * ) Notice: Subject to any disclaimer, the term of this patent is extended or adjusted under 35 U.S.C. 154(b) by 0 days.

(21) Appl. No.: 09/802,419

(22) Filed: Mar. 9, 2001

(65) Prior Publication Data

US 2002/0148921 A1 Oct. 17, 2002

(51) Int. Cl.[7] ..... B65H 19/26

(52) U.S. Cl. ..... 242/527.1; 83/304; 83/346; 83/563; 242/533.4

(58) Field of Search ..... 242/527.1, 527, 242/527.2, 527.3, 527.4, 533.4, 533.5, 533.6; 83/304, 305, 346, 563, 649

(56) References Cited

U.S. PATENT DOCUMENTS

| | | | | | |
|---|---|---|---|---|---|
| 3,128,057 | A | * | 4/1964 | Barnhart et al. | 242/527.1 |
| 3,369,766 | A | * | 2/1968 | Herman | 242/527.1 |
| 3,549,097 | A | * | 12/1970 | Seigh | 242/527.1 |
| 3,567,552 | A | * | 3/1971 | Heuff et al. | 242/527.1 |
| RE28,353 | E | | 3/1975 | Nystrand et al. | |
| 4,280,669 | A | * | 7/1981 | Leanna et al. | 242/527.1 |
| 4,723,724 | A | | 2/1988 | Bradley | |
| 5,104,055 | A | | 4/1992 | Buxton | |
| 6,179,241 | B1 | | 1/2001 | Ba Dour, Jr. et al. | |

* cited by examiner

*Primary Examiner*—John M. Jillions

(57) ABSTRACT

A rewinder includes a lockout cam for controlling the actuation of transfer pins and transfer pads on the bedroll of a rewinder. The transfer pins and transfer pads are mounted on a rotatable pin shaft and a rotatable pad shaft, respectively. A cam follower assembly on the pin shaft is engageable with a pin cam for controlling movement of the transfer pins. A cam follower assembly on the pad shaft is engageable with a pad cam for controlling movement of the transfer pads. The lockout cam is rotatably mounted relative to the bedroll. A first portion of the lockout cam is engageable with the cam follower assemblies for preventing the pin and pad cam follower assemblies from engaging the pin cam and the pad cam, respectively. A second portion of the lockout cam permits the pin and pad cam follower assemblies to engage the pin cam and the pad cam, respectively. During most of the winding cycle, the lockout cam is rotated at the same speed as the bedroll so that the first portion of the lockout cam engages the cam follower assemblies and prevents the cam follower assemblies from engaging the pin and pad cams. Near the end of the winding cycle, the lockout cam is rotated at a different speed than the bedroll so that the second portion of the lockout cam is aligned with the cam follower assemblies and the pin and pad cam follower assemblies engage the pin and pad cams, respectively.

21 Claims, 29 Drawing Sheets

B/R
58
52
59
85
86
83
136.00°
53
55
89
51
54
79
80
81
65
66
C
87
L/O
88
32
64
90
56
38

LOCKOUT CAM FOR A BEDROLL OF A REWINDER

BACKGROUND

This invention relates to a control mechanism for a bedroll of a rewinder. More particularly, the invention relates to a lockout cam for controlling the actuation of the transfer pins and the transfer pads of a bedroll.

Rewinders are used to convert large parent rolls of paper into retail sized rolls of bathroom tissue and paper towels. Two types of rewinders are commonly used—center rewinders and surface rewinders. Center rewinders are described, for example, in U.S. Reissue Pat. No. 28,353 and wind the web on a core which is rotated by a mandrel. Surface rewinders are described, for example, in U.S. Pat. Nos. 4,723,724 and 5,104,055 and wind the web on a core which is rotated by a three roll cradle.

The critical operation in both center rewinders and surface rewinders is the sequence of steps referred to as cutoff and transfer. The web must be severed to end the winding of one roll, the leading edge of the severed web must be transferred to a new core, and the new core must be rotated to begin winding a new roll. These steps must be accomplished repeatedly and reliably while the web is moving at high speed. It is also desirable that each roll have exact sheet count and that the web is wound uniformly and substantially without wrinkles.

The term "bedroll" refers to the main winding roll of a rewinder, either a center rewinder or a surface rewinder.

As described in U.S. Reissue Pat. No. 28,353, a bedroll is commonly used in conjunction with a chopper roll to sever the web after a predetermined length has been wound into a log and to transfer the leading edge of the severed web to a new core in a continuous winding process. In center rewinders a latch mechanism is commonly used to retain the severing and transferring mechanism in an inoperative position until the proper length of web has been wound onto the log. A cam follower is controlled by an electric solenoid or pneumatic cylinder to unlatch the latch mechanism to release the severing and transferring mechanism. The severing and transferring mechanism is then controlled by one or more cams to perform the cutoff and transfer operations on the web. The latch is thereafter reset by the cam to retain the severing and transferring mechanism in the inoperative position.

A conventional latch mechanism and a severing and transferring mechanism for center rewinders is described in detail in U.S. Reissue Pat. No. 28,353. The severing and transfer mechanism includes transfer pins 56, cutoff blades 58 and 59, and transfer pads 55, all of which are movably mounted in the bedroll. When the severing and transfer mechanism is unlatched, the pins 56 hold the web against the rotating bedroll while the web is severed by a chopper roll 49 and the blades 58 and 59 (see FIGS. 20 and 21). The transfer pads thereafter urge the leading end of the severed web against a new core 53 (FIGS. 22 and 23).

The latch mechanism and the severing and transfer mechanism of U.S. Pat. No. Re. 28,353 are mounted on the bedroll and rotate with the bedroll. When the cam followers are latched during normal winding, the cam followers are spaced about 0.025 to 0.040 inch from the cams. When the solenoid is actuated to unlatch the latch mechanism, the impact between the cam followers and the cams can cause undesirable noise, vibration, and wear. The solenoid is also subject to wear and must be replaced periodically.

Surface rewinders sold by Paper Converting Machine Company of Green Bay, Wis. under the name "Magnum" include similar movable pins in a bedroll for holding the severed web against the bedroll and a similar latch mechanism for retaining the pins in an inoperative position until the web is to be severed. A cutoff knife is movably mounted in a chopper roll and is retained in an inoperative position by a latch mechanism which is similar to the latch mechanism which-is used on the bedroll of a center rewinder.

U.S. Pat. No. 6,179,241 describes a latch mechanism which is controlled by a camshaft which is mounted axially in the bedroll and by a servo motor which rotates the camshaft. The servo motor normally rotates the camshaft in the same direction and at the same speed as the bedroll. When the web is to be severed, the speed of the servo motor is either increased or decreased to rotate the camshaft relative to the bedroll. The rotation of the camshaft allows push rods in the bedroll to move radially inwardly to release the severing and transferring mechanism. Cam followers for the severing and transferring mechanism engage a stationary cam and control the movement of the mechanism. After the web is severed and transferred, the camshaft is rotated to force the push rods radially outwardly to relatch the severing and transferring mechanism.

SUMMARY OF THE INVENTION

The invention mounts the cam followers and cams outside of the bedroll. The cam followers and cams are easier to set up and replace and are less expensive than the traditional camming mechanism of U.S. Pat. No. Re. 28,353, and the need for a solenoid is eliminated. The cam followers ride on a lockout cam during normal winding. For cutoff and transfer, the lockout cam is rotated to allow the cam followers to engage pin and pad cams without excessive impact or vibration.

The independently rotatable lockout cam is driven by a servo motor at a speed which is matched to the bedroll during most of the winding cycle. During normal winding, a circular portion of the lockout cam is positioned under the pin and pad cam followers. As the bedroll approaches the point in the cycle where cutoff and transfer are to occur, the servo motor decelerates the lockout cam. During approximately the last three bedroll revolutions of the winding cycle, the lockout cam rotates relative to the bedroll to a point where a window in the lockout cam is aligned with the cam followers. The window allows the cam followers to engage and follow the contours of the pin and pad cams, thereby causing the required cutoff and transfer motions of the pins and pads.

DESCRIPTION OF THE DRAWING

The invention will be explained in conjunction with an illustrative embodiment shown in the accompanying drawing, in which.

DESCRIPTION OF THE SPECIFIC EMBODIMENTS

Figure 1:
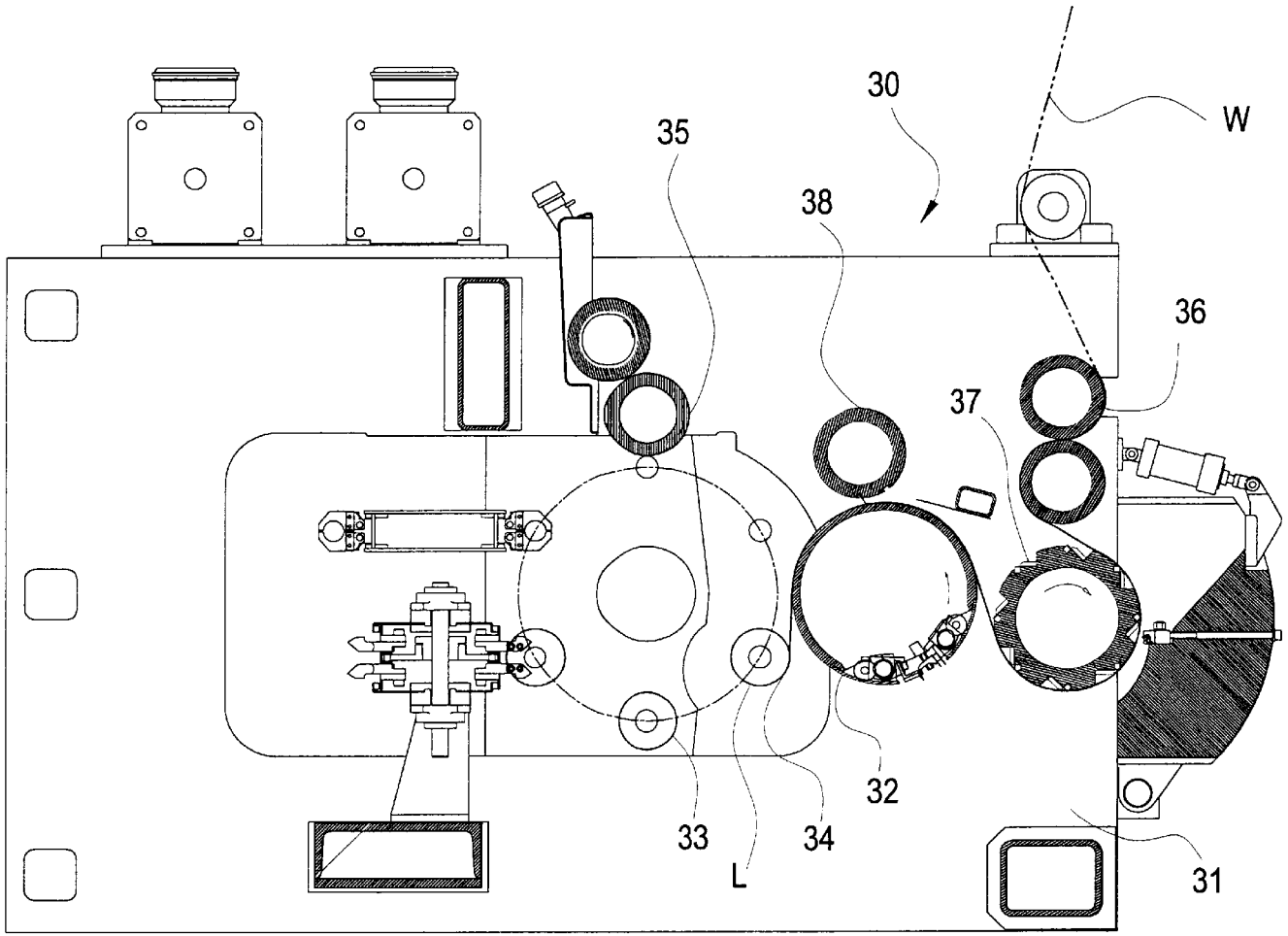
FIG. 1 is a side view from the operator's side of a center rewinder which is equipped with a control mechanism in accordance with the invention.
Figure 2:
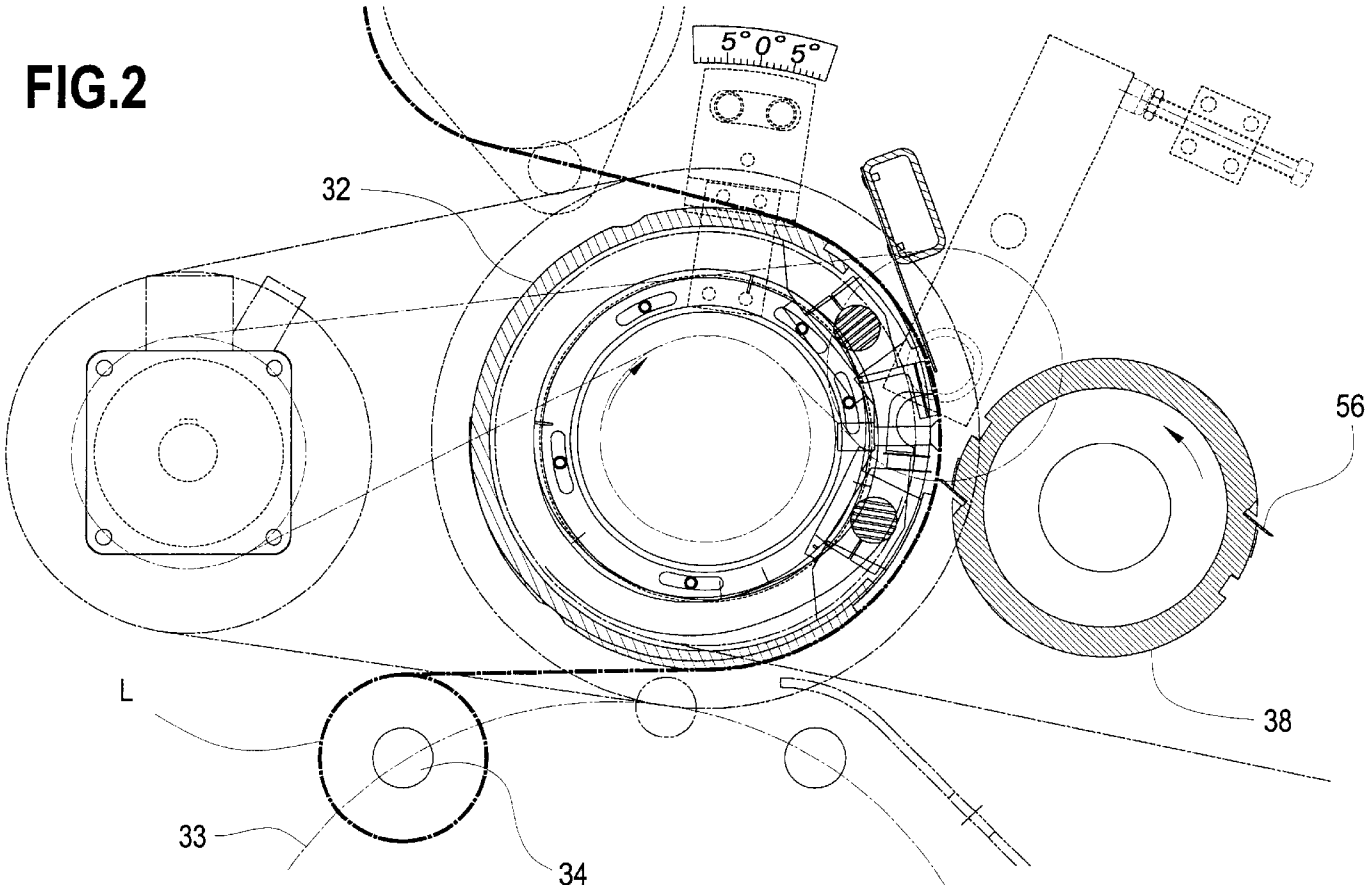
FIG. 2 is an enlarged fragmentary side view from the drive side of the bedroll and chopper roll of the rewinder of FIG. 1.

The invention will be explained in conjunction with a center rewinder 30 illustrated in FIGS. 1 and 2. However, it will be understood that the invention can also be used with surface rewinders.

The rewinder 30 includes a frame 31 and a bedroll 32 which is rotatably mounted in the frame. A turret assembly 33 is rotatably mounted in the frame below the bedroll. As is well known in the art, the turret assembly includes a plurality of rotating mandrels 34 on which paperboard cores are mounted. An adhesive applying apparatus 35 applies transfer adhesive to a new core before each winding cycle.

A web W is advanced by draw rolls 36 through a perforator 37 to the bedroll 32. The perforator forms longitudinally spaced transverse lines of perforation in the web.

The surface speed of the bedroll matches the speed of the web, and the bedroll delivers the web to a log L which is being wound on the mandrel at about the 5:00 o'clock position of the bedroll. When the proper length of web has been wound on the log, the web will be severed by a chopper roll 38 and a new winding cycle will begin.

Figure 3:
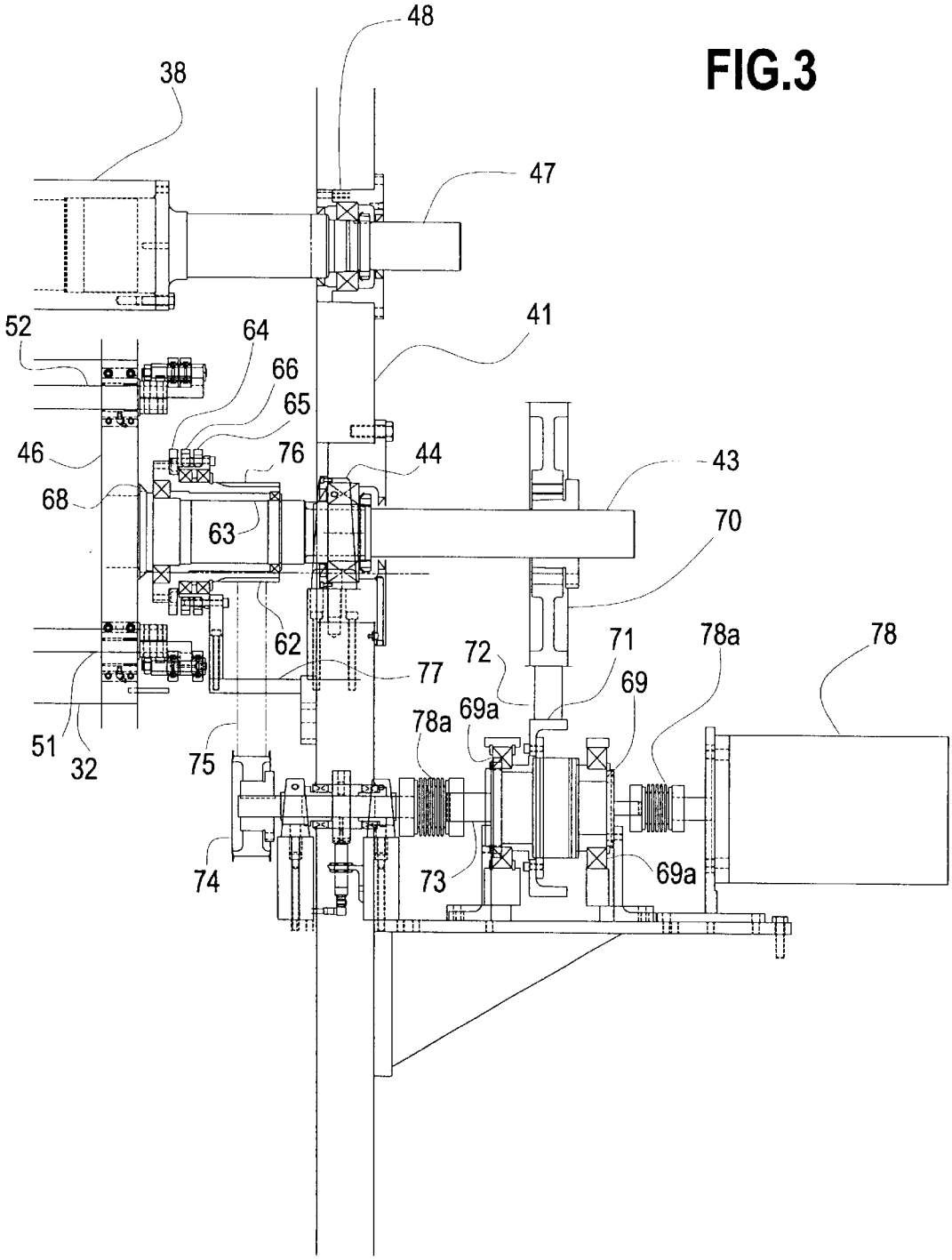
FIG. 3 is a fragmentary end view of the bedroll and chopper roll of the rewinder.

Referring now to FIG. 3, the frame of the rewinder includes a pair of side frames 41 which rotatably support the bedroll 32 and the chopper roll 38. Each end of the bedroll includes an end plate 42 and a journal 43 which is rotatably mounted in a bearing 44 in one of the side frames 41. Each end of the chopper roll includes a journal 47 which is rotatably mounted in a bearing 48 in the side frame.

A transfer pin shaft 51 and a transfer pad shaft 52 are rotatably mounted in the end plates 42 of the bedroll. A plurality of transfer pins 53 (FIG. 8) are clamped to the transfer pin shaft 51 by clamps 54. The transfer pins are spaced-apart axially along the length of the bedroll.

A pair of spaced-apart cutoff blades 55 is mounted on each of the transfer pins. As will be explained in detail hereinafter, the cutoff blades 55 cooperate with a cutoff knife 56 on the chopper roll 38 to sever the web.

A plurality of transfer pads 58 (FIG. 8) are clamped to the transfer pad shaft 52 by clamps 59. The transfer pads are also spaced axially along the length of the bedroll, and each transfer pad is advantageously positioned adjacent one of the transfer pins.

Figure 4:
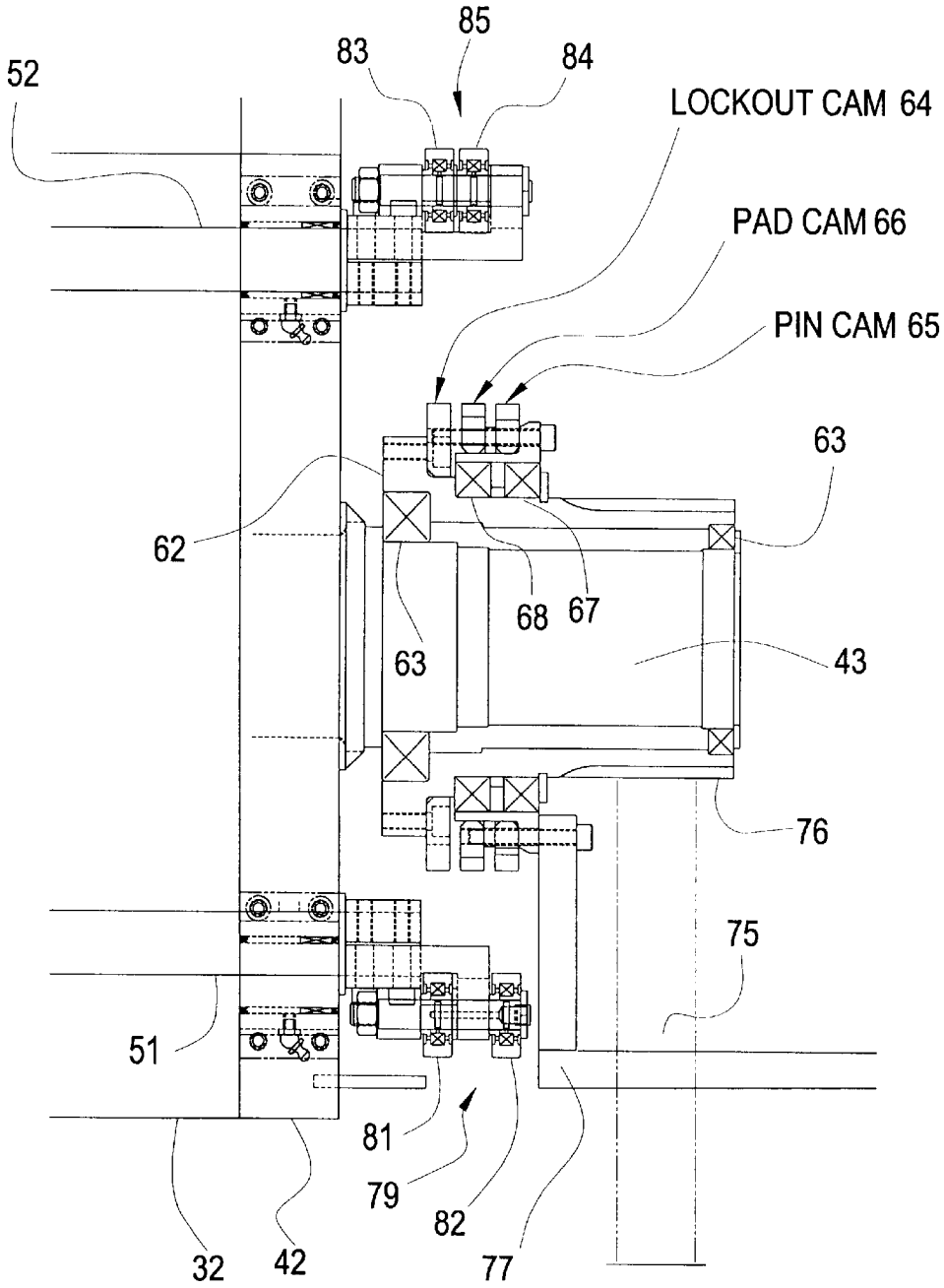
FIG. 4 is an enlarged fragmentary view of a portion of FIG. 3.

Referring now to FIGS. 3 and 4, a hub or bushing 62 is rotatably mounted on the journal 43 of the bedroll by bearings 63. A lockout cam 64 is mounted on the bushing for rotation with the bushing. A pin cam 65 and a pad cam 66 are rotatably mounted on the bushing by bearings 67 and 68, respectively.

In the embodiment illustrated in FIG. 3, the lockout cam is rotated at bedroll speed during most of the winding cycle by a differential 69 which is rotatably supported by bearings 69*a*. The differential is available from Die Qua of Germany. A pulley 70 on the bedroll journal 43 is connected to a pulley 71 on the differential housing by a belt 72. A shaft 73 from the differential is connected to the hub 62 by a pulley 74 and a belt 75. The belt 75 includes teeth which engage teeth on the pulley 74 and teeth 76 on the hub 62. The pin cam 65 and the pad cam 66 are maintained stationary as the bushing 62 rotates by a bracket 77 which connects the cams to the side frame 41. An electric servo motor 78 changes the rotational speed of the shaft 73 relative to the speed of the bedroll. Flexible couplings 78*a* are located on each side of the differential to accommodate any misalignment in the shaft connections to the differential.

The lockout cam hub 62 to which the lockout cam 64 is rigidly attached must be decelerated to a speed roughly half of the bedroll speed in a period of about three bedroll having a circumference of one meter takes only 56 milliseconds. So the total speed change has to happen in about 168 milliseconds, which is a very short time. If the hub were driven directly with a servo, a large torque would be required to make this speed change, probably requiring the use of a hydraulic motor, which would add cost a complexity.

The speed change can be accomplished with an electric servo by running the motion through the differential 69. Basically, the differential is a mechanical motion "combiner", and the output from the differential is the sum of a constant rpm input from the bedroll journal plus the trim rpm input from the electric servo 78.

The scheme allows the lockout cam hub 62 to be mechanically driven at exact bedroll speed without the servo having to drive it at all during normal "latched" operation. Then when the speed change is required for transfer, the trim servo rotates to add (or subtract in this case) a differential speed on top of the constant rpm input from the bedroll journal. In this way, the servo just has to rotate the amount to achieve the difference in velocity—not the entire output velocity. The advantage gained from this reduced servo velocity requirement allows incorporating a larger reduction ratio to the servo motor which, in turn, multiplies the torque output to the level that is needed.

A cam follower assembly 79 (FIGS. 4 and 8) is mounted on the end of the transfer pin shaft 51. The cam follower assembly includes a bracket 80 which is attached to the transfer pin shaft 51 and a pair of cam follower rollers 81 and 82 which are rotatably mounted in the bracket. The cam follower 81 is aligned with the lockout cam 64, and the cam follower 82 is aligned with the pin cam 65. The cam followers 81 and 82 are spaced apart so that the transfer pin shaft is not affected by the pad cam 66.

A cam follower assembly 85 is similarly mounted on the end of the transfer pad shaft 52 and includes a bracket 86 and cam follower rollers 83 and 84. The cam follower 83 is aligned with the lockout cam 64, and the cam follower 84 is aligned with the pad cam 66.

Figure 5:
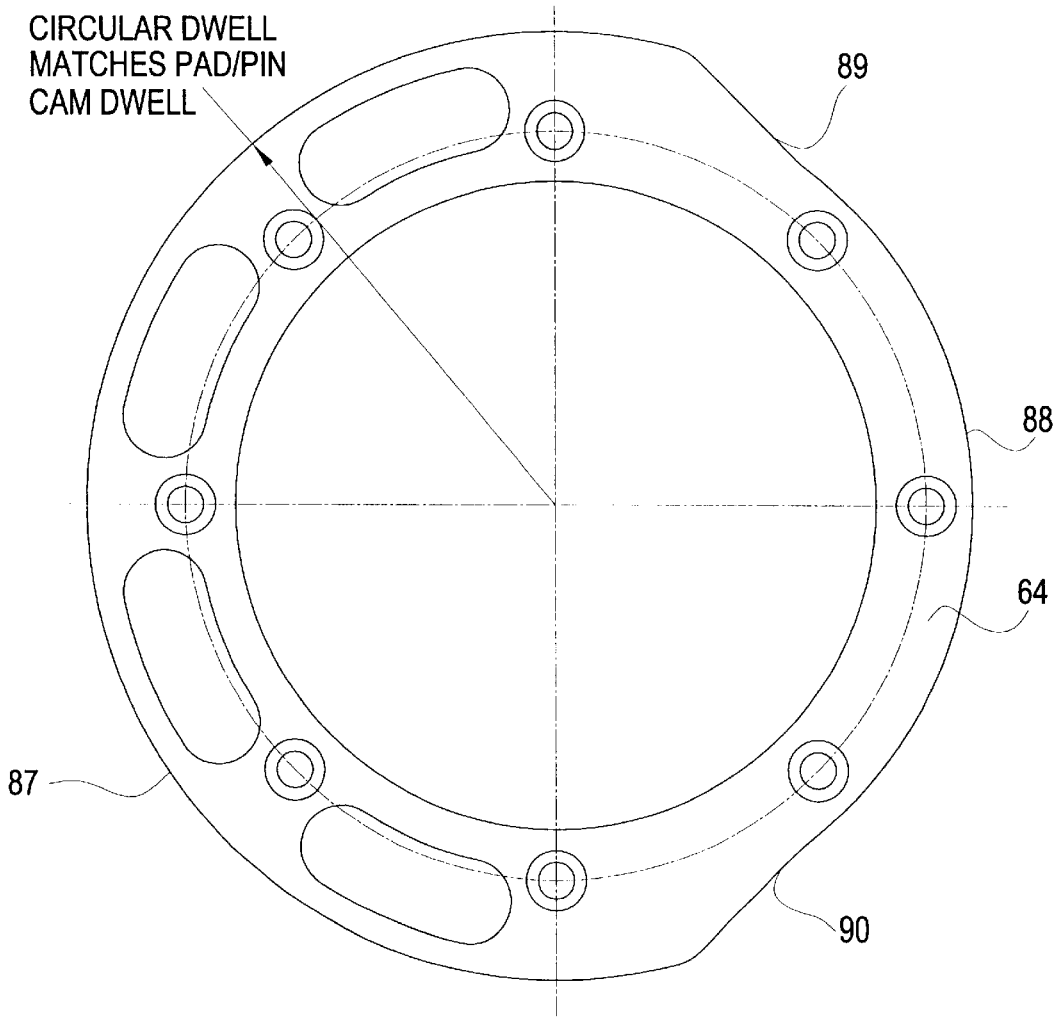
FIG. 5 is a side view of the lockout cam.
Figure 6:
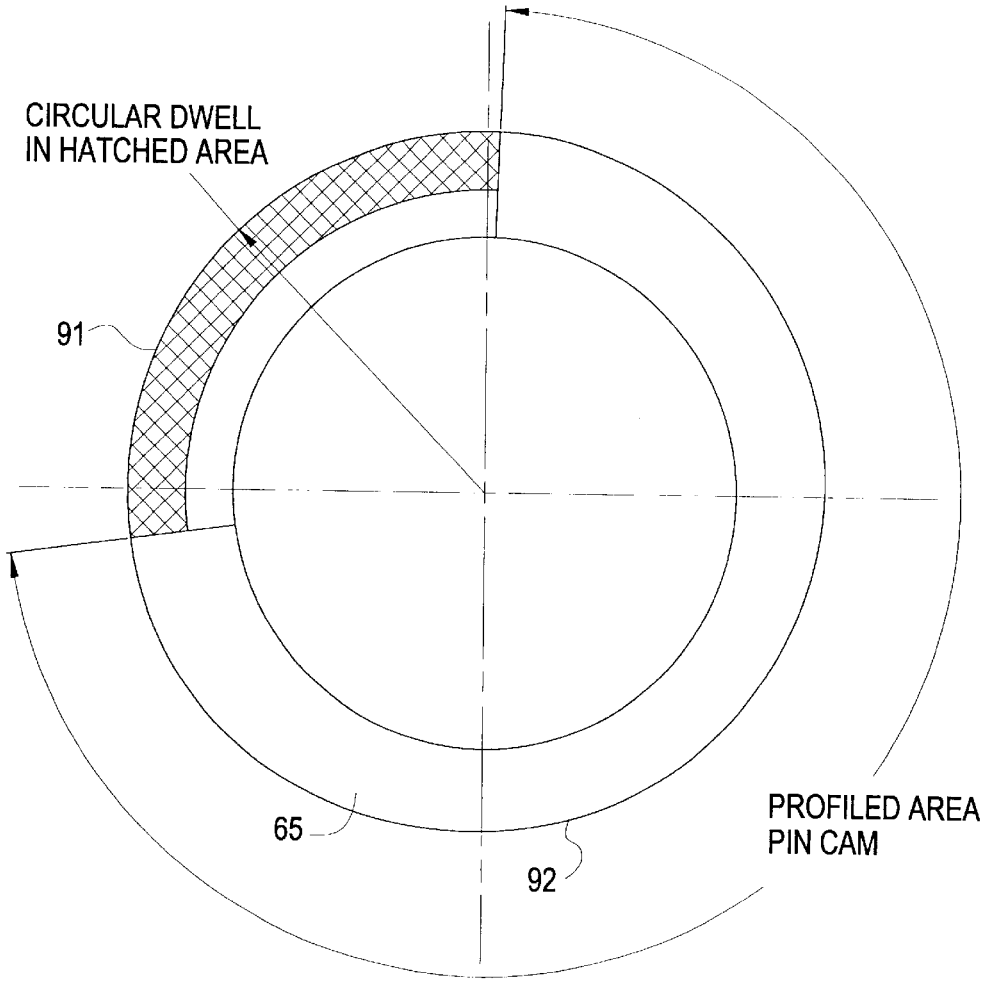
FIG. 6 is a side view of the pin cam.
Figure 7:
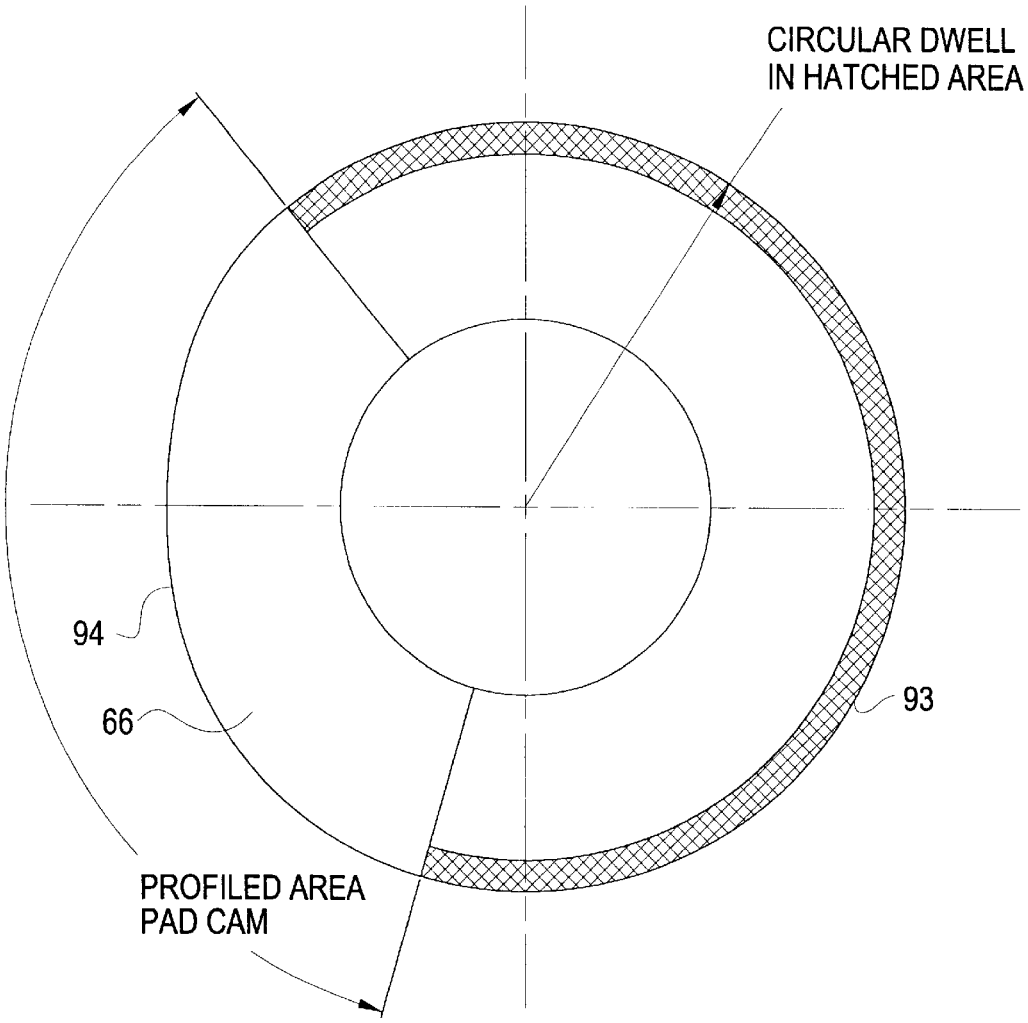
FIG. 7 is a side view of the pad cam.

The contour of the lockout cam 64 is illustrated in FIG. 5 and in FIGS. 8–23 by the dark line. The lockout cam includes a first or major portion 87 which has a circular contour and a second portion 88 which provides a window or notch which has a contour which is positioned radially inwardly of the circular portion 87. The ends 89 and 90 of the window portion 88 merge smoothly with the circular portion.

The contours of the pin cam 65 and the pad cam 66 are also illustrated in FIGS. 6 and 7 and FIGS. 8–23. The pin cam has a contour which controls the movement of the transfer pins 53 when the cam follower 82 of the cam follower assembly 79 on the transfer pin shaft engages the pin cam. The pin cam includes a circular dwell portion 91 and a contoured or profiled portion 92.

The pad cam 66 has a contour which controls the movement of the transfer pads 58 when the cam follower 84 on the transfer pad shaft engages the pad cam. The pad cam has a circular dwell portion, 93 and a profiled portion 94.

FIGS. 8–23 illustrate the positions of the lockout cam 64, pin cam 65, pad cam 66, transfer pins 53, and transfer pads 58 at various points during the winding cycle. The web is omitted from FIGS. 8–23 for clarity of illustration. The cam followers 81 and 82 of the cam follower assembly 79 are axially aligned in the bracket 80, and movement of the cam follower assembly 79 is controlled by the cam 64 or cam 65 whose surface is most radially outward. Similarly, movement of the cam follower assembly 85 is controlled by the cam 64 or cam 66 whose surface is most radially outward and engages the cam follower 83 or the cam follower 84.

During normal winding of the web on a core to form a log L (FIG. 1), the lockout cam 64 is rotated at the same speed as the speed of the bedroll 32, and the circular portion 87 of the lockout cam engages the cam followers 81 and 83 on the transfer pin shaft 51 and the transfer pad shaft 52. The cam followers 82 and 84 are thereby prevented from contacting the pin cam 65 and the pad cam 66, respectively, and the transfer pins 53 and transfer pads 58 are positioned inside of the outer surface of the bedroll as illustrated in FIG. 3.

As the rotating bedroll approaches the point in the winding cycle where cutoff and transfer are to occur, the servo motor 78 starts to accelerate the shaft 73 and the lockout cam so that the lockout cam rotates relative to the bedroll. During approximately the last three bedroll revolutions of the winding cycle, the lockout cam rotates relative to the bedroll to a point where the window 88 in the lockout cam is below the cam followers 81 and 83. This allows the cam followers 82 and 84 to move into engagement with the pin cam 65 and pad cam 66, respectively, so that the transfer pins 53 and transfer pads 58 follow the required cutoff and transfer motions.

Figure 8:
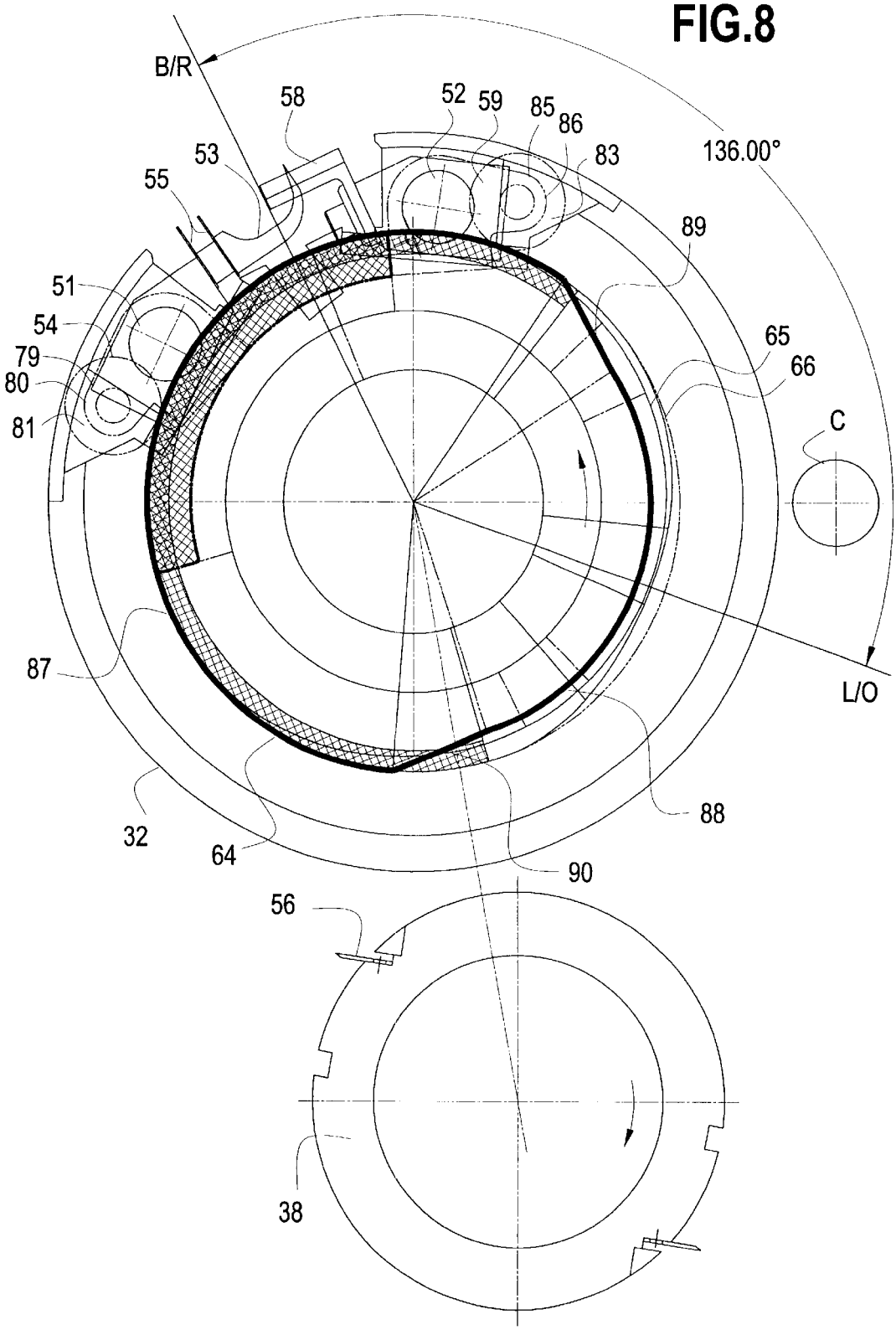
FIGS. 8 through 23 are side views of the bedroll and chopper roll at discrete moments during the winding cycle.

FIG. 8 illustrates the positions of the bedroll and the lockout cam at the beginning of the cutoff and transfer cycle. The position of the bedroll in Figure a is indicated by the radial line B/R and will be considered the zero degree position. The position of the lockout cam 64 is illustrated by the radial line L/O which extends through the center of the window portion 88. The bedroll and the lockout cam are rotating counterclockwise in FIG. 8 as indicated by the arrow. The position of the lockout cam lags 136° behind the position of the bedroll.

FIGS. 9–23 illustrate subsequent points during the next 7½ revolutions of the bedroll as indicated in Table 1:

TABLE 1

| FIG. No. | Reference Bedroll Position (degrees) | Relative Lookout Cam Position (degrees) | Notes |
|---|---|---|---|
| 8 | 0 (0 Rev) | 136.00 Lagging | Start of Cycle L/O cam matched with bedroll. Pin and pad cam followers riding on L/O cam |
| 9 | 180 (½ Rev) | 138.46 Lagging | L/O cam shifting backward relative to bedroll with accelerating speed. Pin and pad cam followers still riding on L/O cam |

TABLE 1-continued

| FIG. No. | Reference Bedroll Position (degrees) | Relative Lookout Cam Position (degrees) | Notes |
|---|---|---|---|
| 10 | 360 (1 Rev) | 154.56 Lagging | L/O cam shifting backward relative to bedroll with accelerating speed. Pin and pad cam followers still riding on L/O cam |
| 11 | 540 (1½ Rev) | 192.80 Lagging | L/O cam shifting backward relative to bedroll with accelerating speed. Pin and pad cam followers still riding on L/O cam |
| 12 | 720 (2 Rev) | 253.35 Lagging | L/O cam shifting backward relative to bedroll. Pin cam follower now riding on pin actuating cam. Pad cam follower still riding on L/O |
| 13 | 900 (2½ Rev) | 328.00 Lagging | L/O cam shifting backward relative to bedroll. Pin cam follower riding on pin actuating cam. Cutoff has occurred. Pad cam follower still riding on L/O cam |
| 14 | 1080 (3 Rev) | 45.32 Leading | L/O cam shifting backward relative to bedroll. Pad cam follower now riding on pad actuating cam. Transfer has occurred Pin cam follower back on L/O cam |
| 15 | 1260 (3½ Rev) | 118.38 Leading | L/O cam shifting backward relative to bedroll with decelerating speed. Pin and pad followers now both back on L/O cam |
| 16 | 1440 (4 Rev) | 177.43 Leading | L/O cam shifting backward relative to bedroll with decelerating speed. Pin and pad cam followers now both back on L/C cam |
| 17 | 1620 (4½ Rev) | 214.21 Leading | L/O cam shifting backward relative to bedroll with decelerating speed. Pin and pad cam followers both on L/O cam |
| 18 | 1800 (5 Rev) | 223.54 Leading | L/O cam instantaneously matched speed with bedroll. Pin and pad cam followers both on L/O cam |
| 19 | 1980 (5½ Rev) | 205.76 Leading | L/O cam shifting forward relative to bedroll with accelerating speed. Pin and pad cam followers both on L/O cam. (Resetting for next transfer.) |
| 20 | 2160 (6 Rev) | 175.36 Leading | L/O cam shifting forward relative to bedroll. Pin and pad cam followers both on L/O cam. (Resetting for next transfer.) |
| 21 | 2340 (6½ Rev) | 150.30 Leading | L/O cam shifting forward relative to bedroll. Pin and pad cam followers both on L/O cam. (Resetting for next transfer.) |
| 22 | 2520 (7 Rev) | 138.02 Leading | L/O cam shifting forward relative to bedroll with decelerating speed. Pin and pad cam followers both on L/O cam. (Resetting for next transfer.) |

TABLE 1-continued

| FIG. No. | Reference Bedroll Position (degrees) | Relative Lookout Cam Position (degrees) | Notes |
|---|---|---|---|
| 23 | 2700 (7½ Rev) | 136.00 Leading | L/O cam matched speed with bedroll. Pin and pad cam followers both on L/O cam. (Ready for next transfer sequence) |

In FIG. 8 the rotational speed of the lockout cam 64 matches the rotational speed of the bedroll 32. The cam followers 81 and 83 on the transfer pin shaft 51 and transfer pad shaft 52, respectively, ride on the circular portion 87 of the lockout cam. The transfer pins 53 and the transfer pads 58 are positioned radially inwardly of the outer surface of the bedroll.

Figure 9:
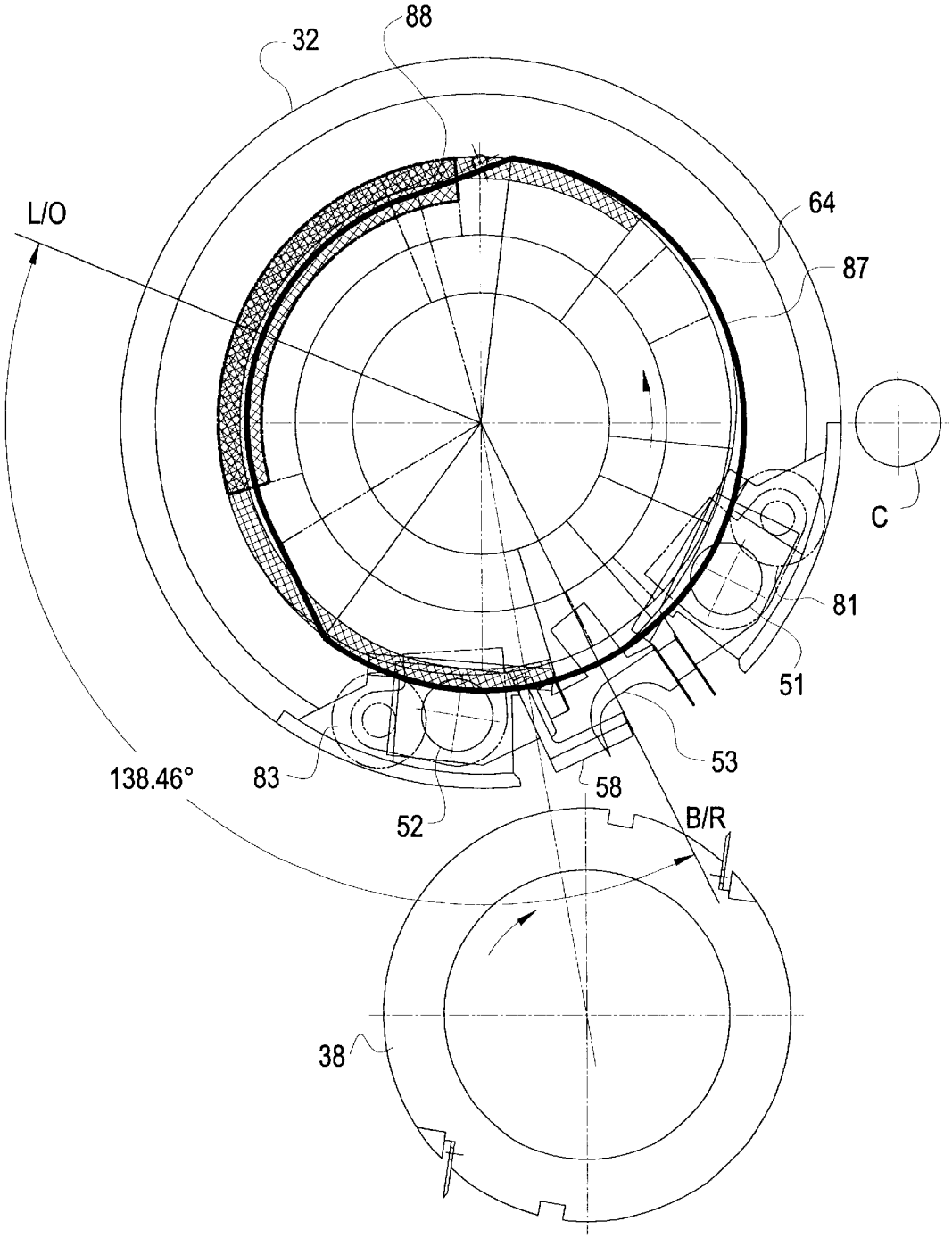

In FIG. 9 the bedroll has rotated 180° from its FIG. 8 position, and the lockout cam 64 has begun shifting backward relative to the bedroll. The cam followers 81 and 83 still ride on the circular portion 87 of the lockout cam.

Figure 10:
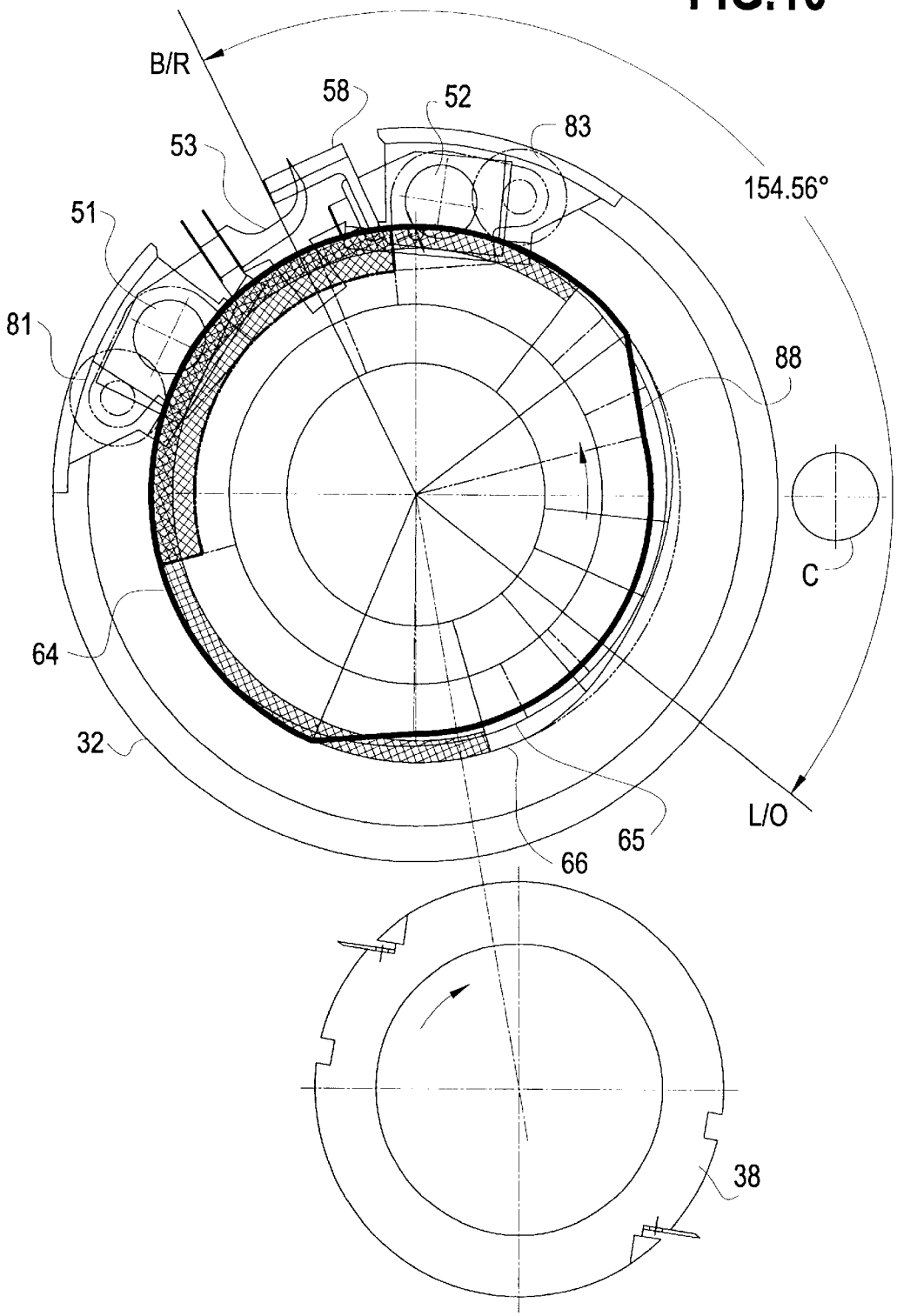

In FIG. 10 the bedroll has rotated 360° from its FIG. 8 position, and the lockout cam continues to move backward relative to the bedroll. The cam followers 81 and 83 still ride on the circular portion of the lockout cam.

Figure 11:
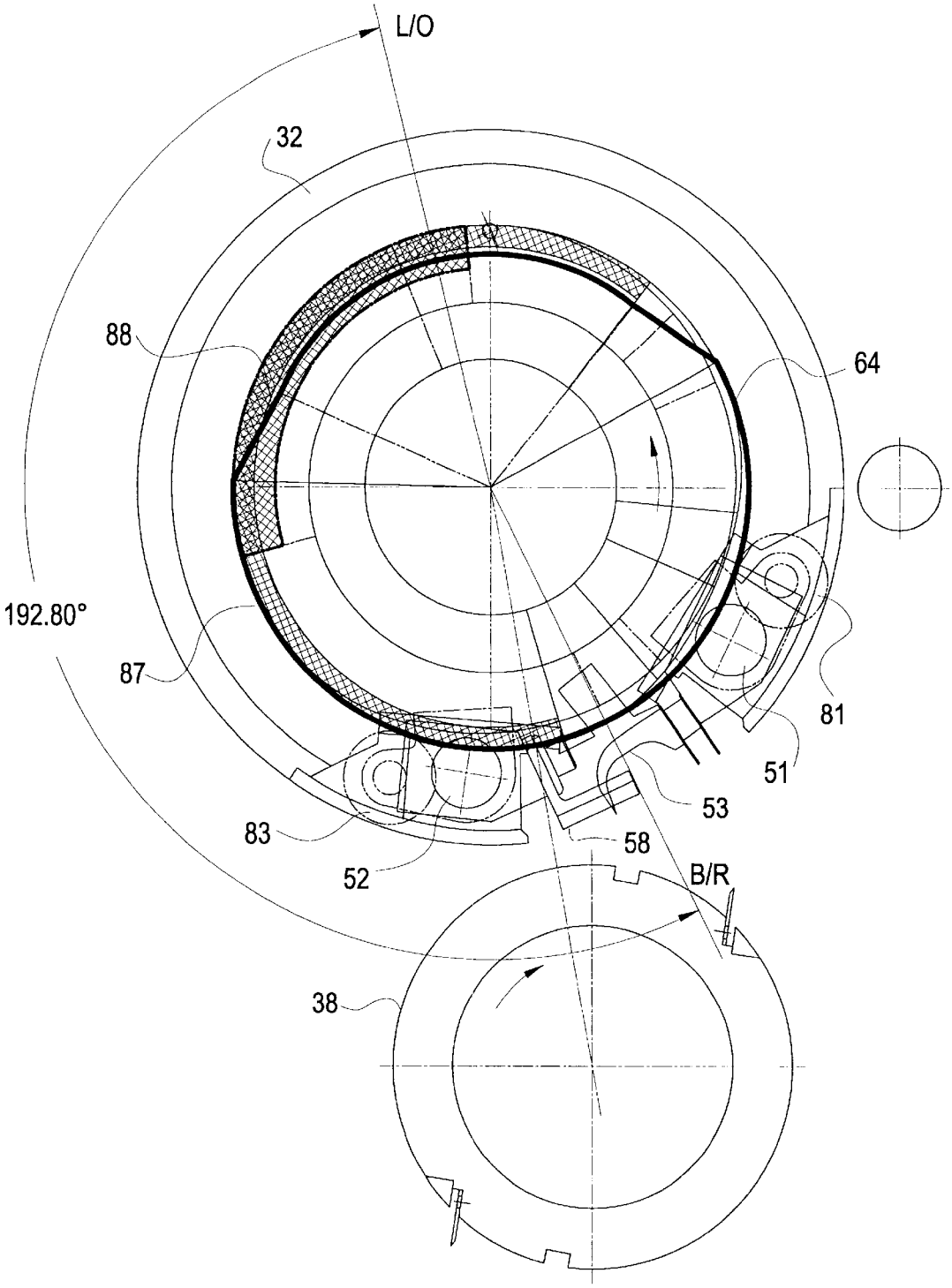

FIG. 11 illustrates the bedroll after 1½ revolutions from the FIG. 8 position. The cam followers 81 and 83 continue to ride on the circular portion of the lockout cam.

Figure 12:
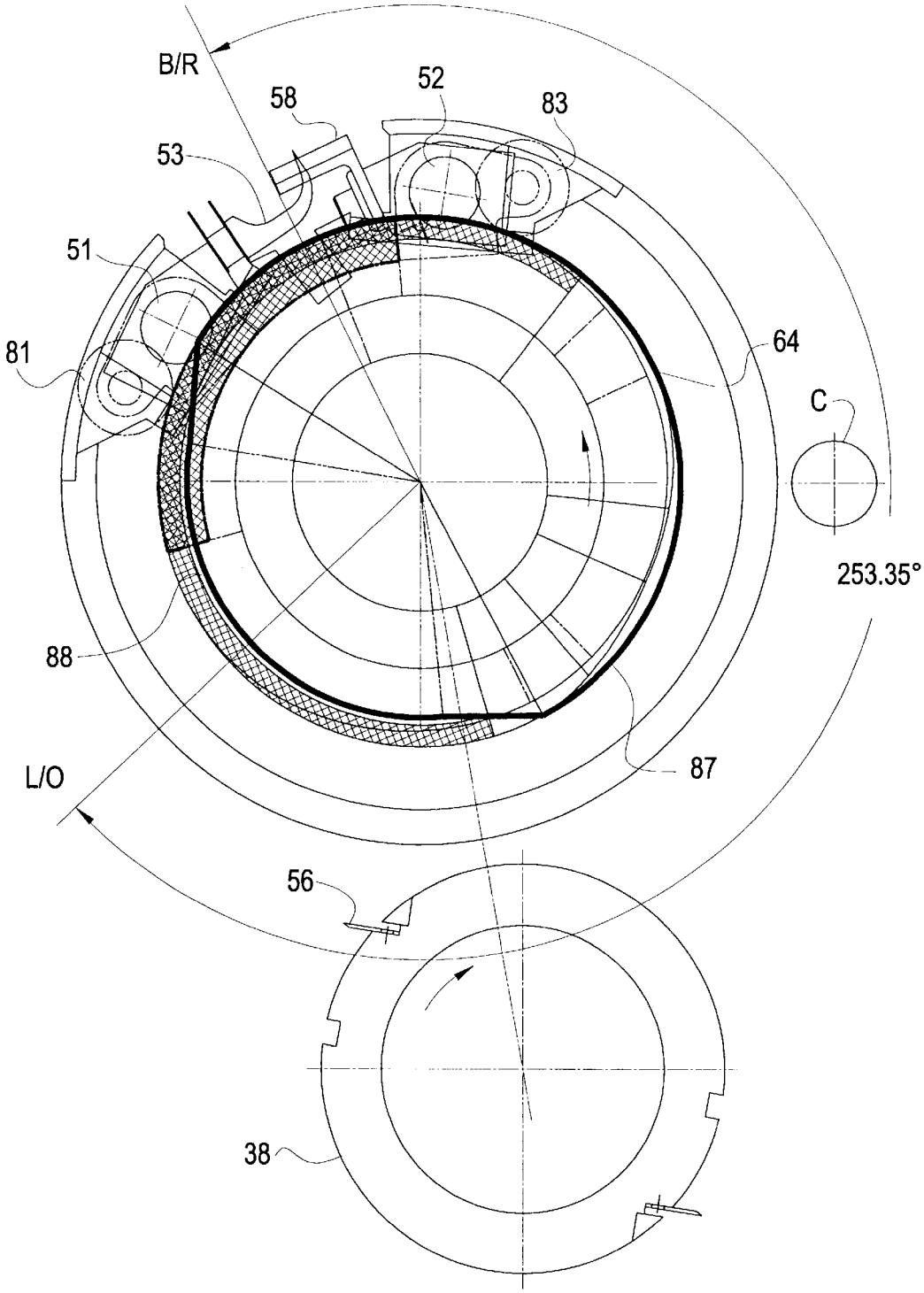

In FIG. 12 the bedroll has rotated two revolutions from its FIG. 8 position, and the cam follower 81 on the transfer pin shaft 51 is aligned with the window portion 88 of the lockout cam 64. The cam follower 82 on the transfer pin shaft 51 engages the pin cam 65, and movement of the transfer pins 53 is now controlled by the pin cam. The cam follower 81 moves smoothly from the circular portion 87 of the lockout cam to the window portion 88 of the lockout cam, and the cam follower 82 engages the pin cam 65 without causing significant impact or vibration. The cam follower 83 on the transfer pad shaft 52 continues to ride on the circular portion 87 of the lockout cam.

Figure 13:
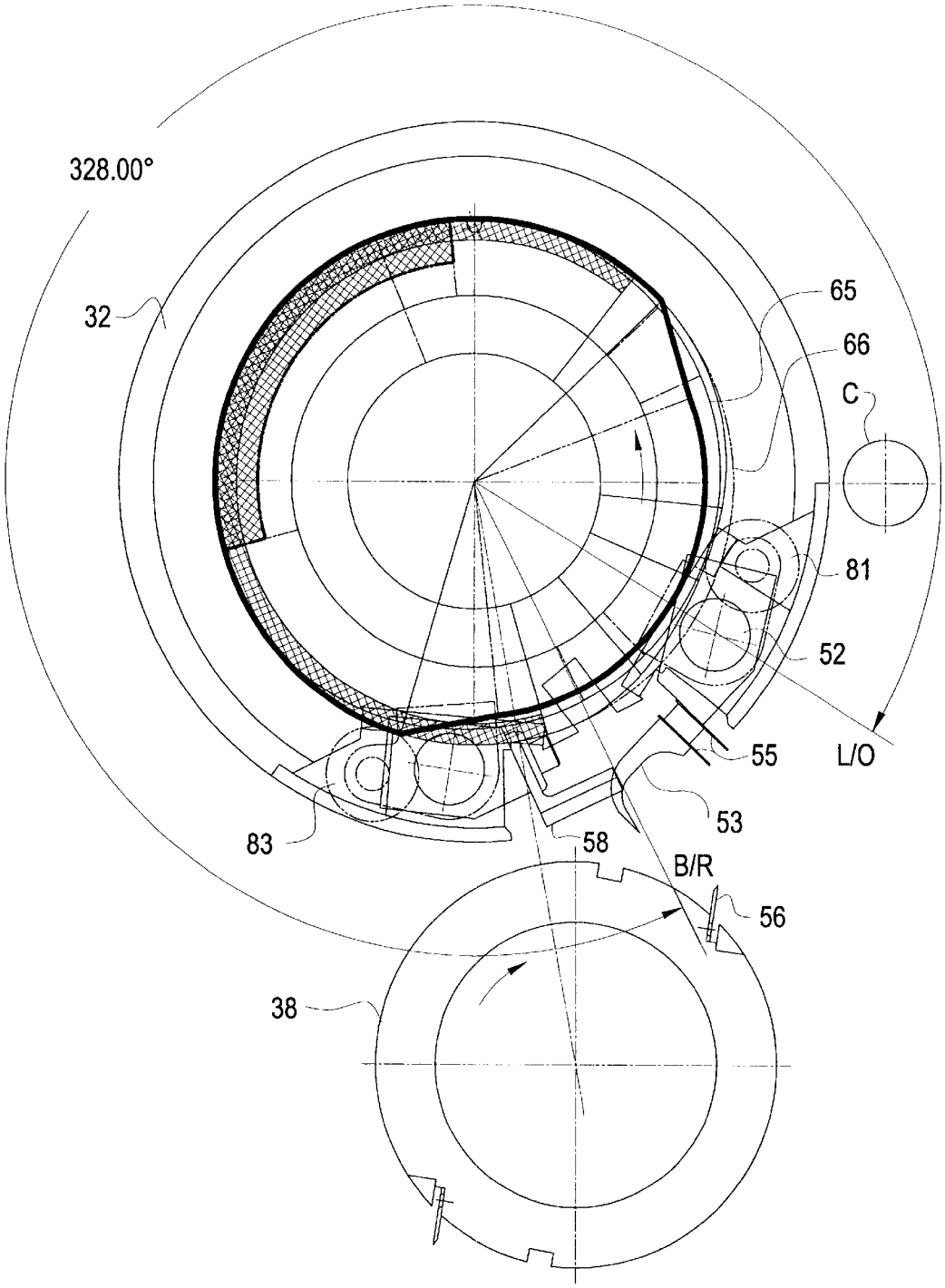
Figure 24:
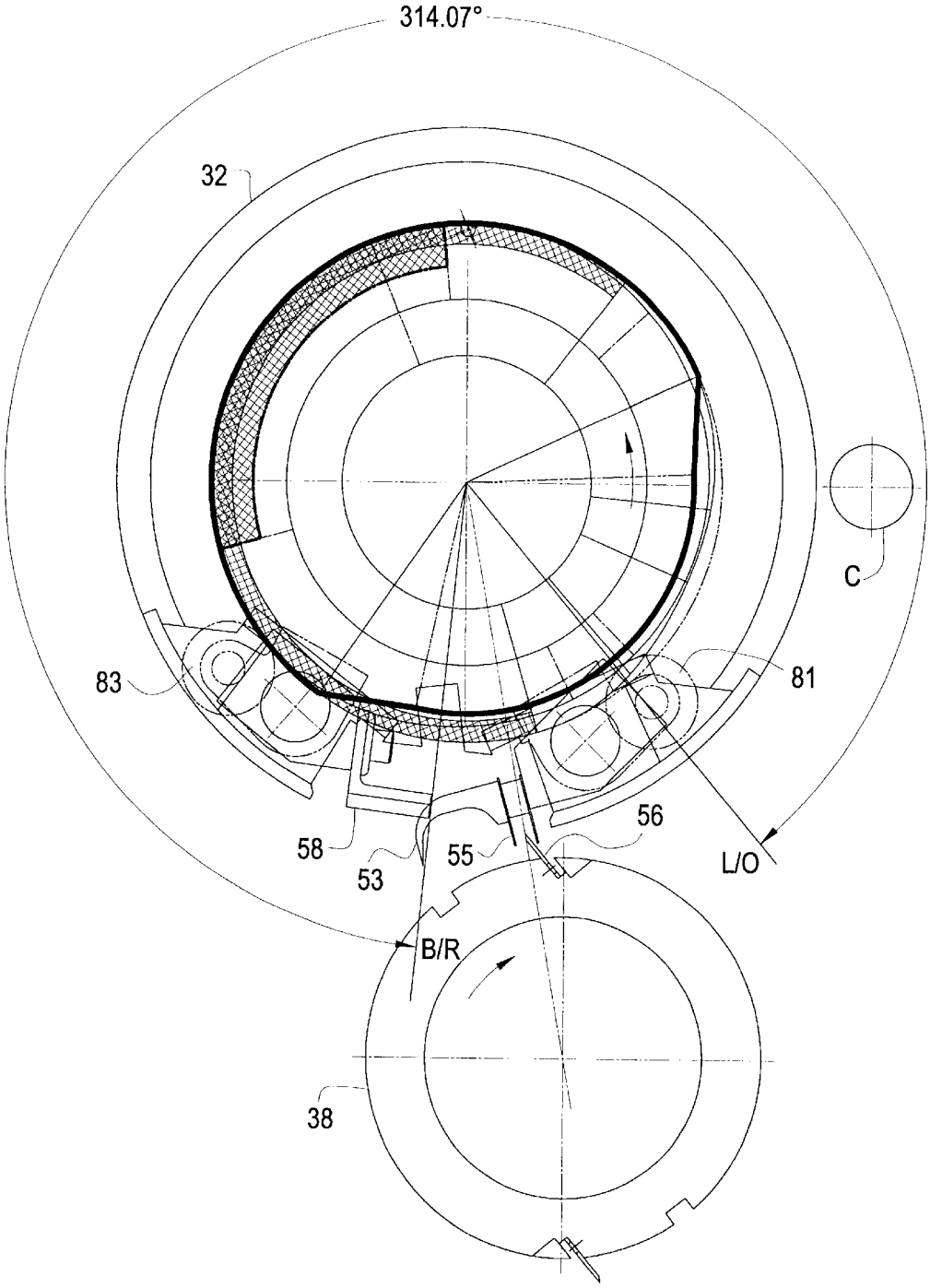
FIG. 24 is a side view of the bedroll and chopper roll at cutoff.

FIG. 13 illustrates the position of the bedroll one-half revolution after FIG. 12 and just after the web has been severed. The positions of the bedroll and chopper roll at cutoff are illustrated in FIG. 24. As is well known in the rewinder art and as described in U.S. Pat. No. Re. 28,353, the contour of the pin cam 65 causes the transfer pins 53 to pivot outwardly beyond the outer surface of the bedroll so that the transfer pins impale the web (not shown in FIG. 8 for clarity of illustration) which wraps a portion of the outer surface of the bedroll. As the bedroll continues to rotate toward the cutoff knife 56 on the chopper roll 38, the cutoff knife enters the space between the cutoff blades 55 on the transfer fingers 53 to sever the web. After the web is severed, the leading end portion of the web is held on the rotating bedroll by the transfer pins 53. As described in U.S. Pat. No. Re. 28,353, the portion of the web between the severed leading edge and the transfer pins may fold back as the bedroll rotates. In FIGS. 13 and 24 the cam follower 83 on the transfer pad shaft 52 continues to ride on the circular portion 87 of the lockout cam.

Figure 25:
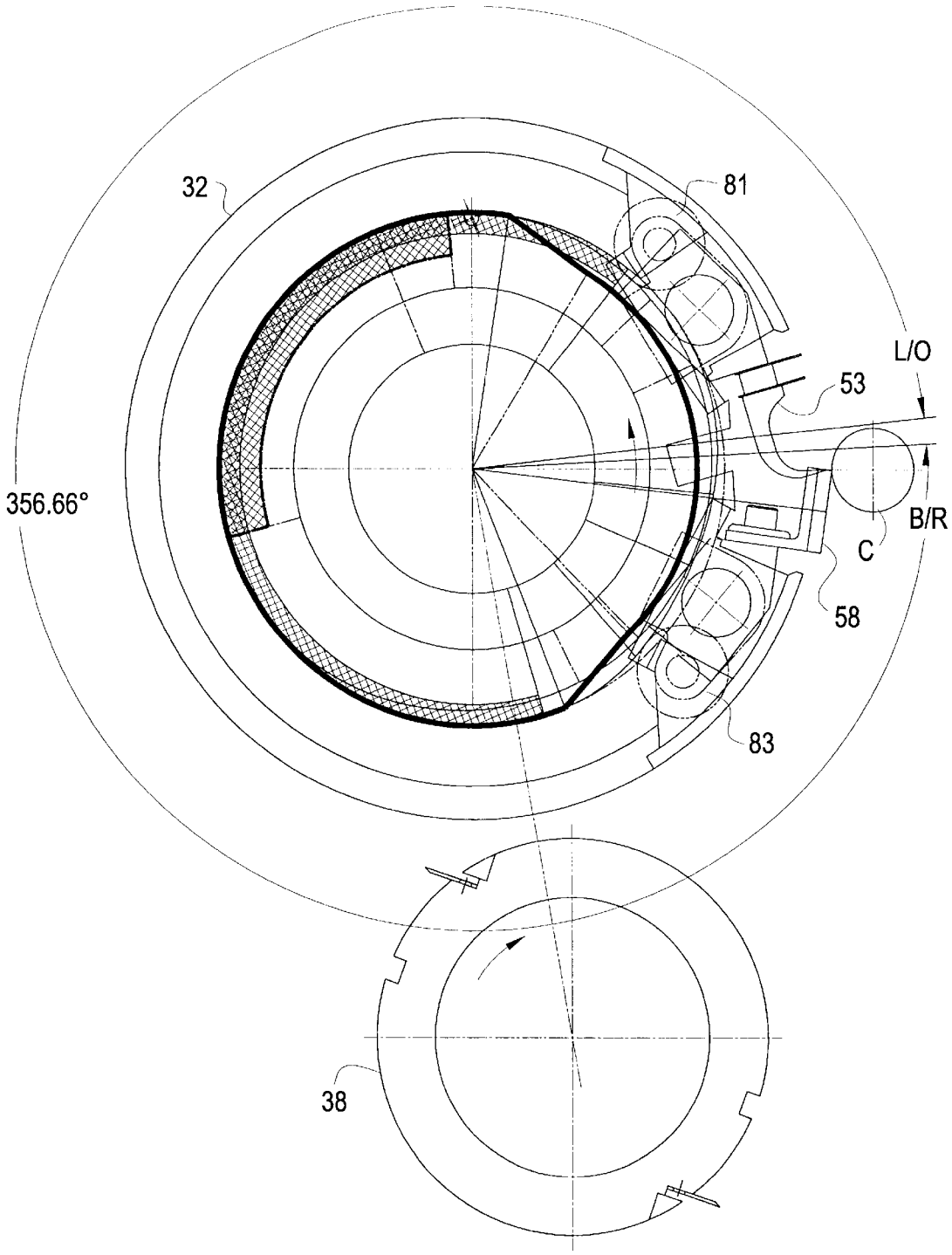
FIG. 25 is a side view of the bedroll and chopper roll at transfer.

As the bedroll continues to rotate from its FIG. 24 position to its FIG. 25 position, the cam follower 83 on the transfer pad shaft will move to the window 88 of the lockout cam, and the cam follower 84 will begin to ride on the pad cam 66. As is well known in the rewinder art, the contour of the pad cam will cause the transfer pads 58 to move radially outwardly beyond the outer surface of the bedroll to push the severed leading end of the web against a new core C which is carried by the turret assembly 33 (FIG. 1). The core is mounted on a mandrel 34 which rotates the core clockwise. As the bedroll moves from its FIG. 24 position, the pin cam 65 causes the transfer pins to rotate clockwise so that the pins are positioned radially inwardly of the new core at transfer. The pad cam 66 causes the transfer pads to push the web onto the new core C. The new core is provided with conventional rings or stripes of transfer adhesive so that the web is transferred to the new core.

Figure 14:
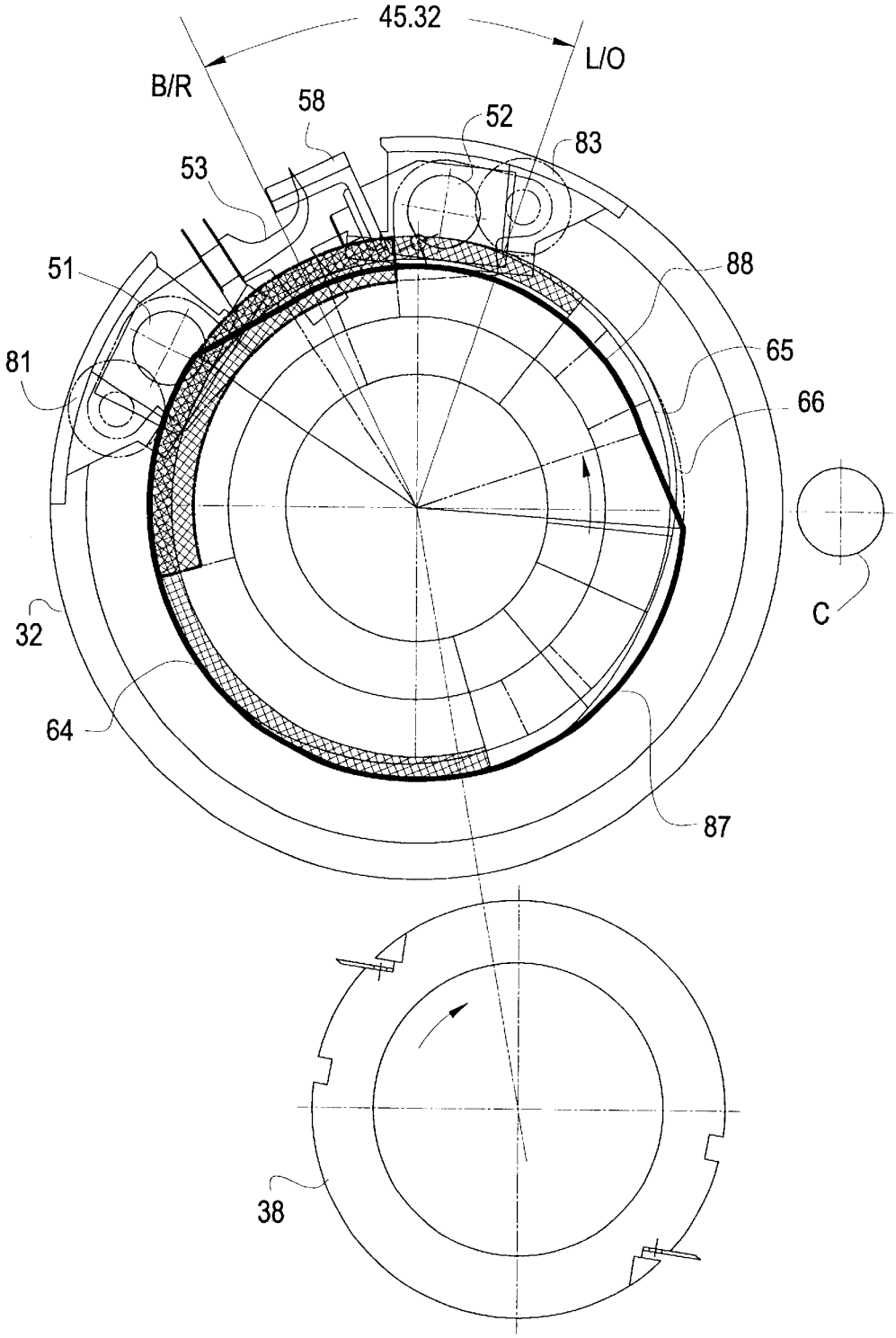

FIG. 14 illustrates the position of the bedroll one-half revolution after its FIG. 13 position. The cam follower 84 on the transfer pad shaft 52 is riding on the pad cam 66. The web has already been transferred to the new core C, and the web is being wound on the rotating core. The cam follower 81 on the transfer pin shaft 51 has moved from the window portion 88 of the lockout cam back to the circular portion 87 of the lockout cam, and the cam follower 82 on the transfer pin shaft is thereby moved out of engagement with the pin cam 65.

Figure 15:
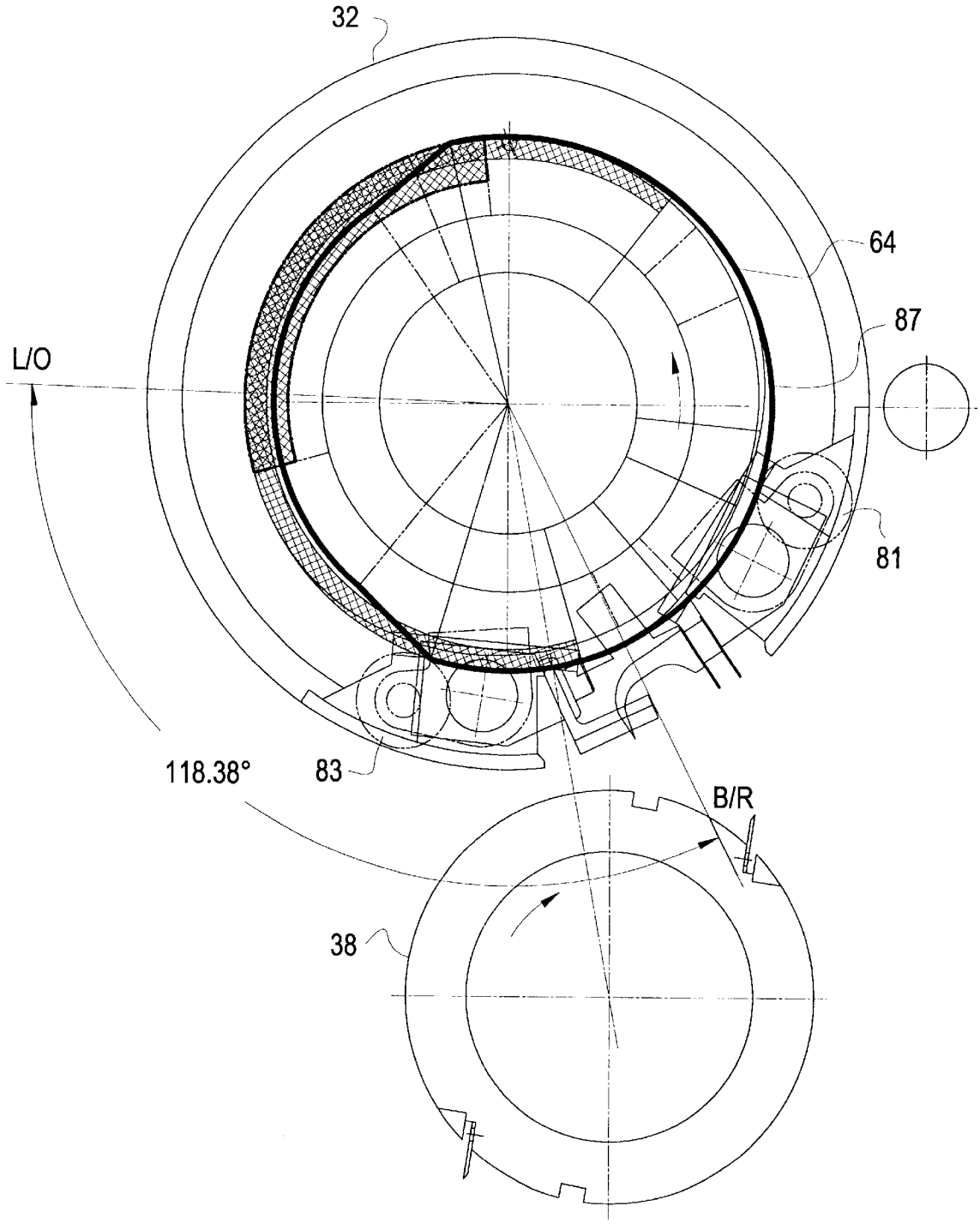
Figure 16:
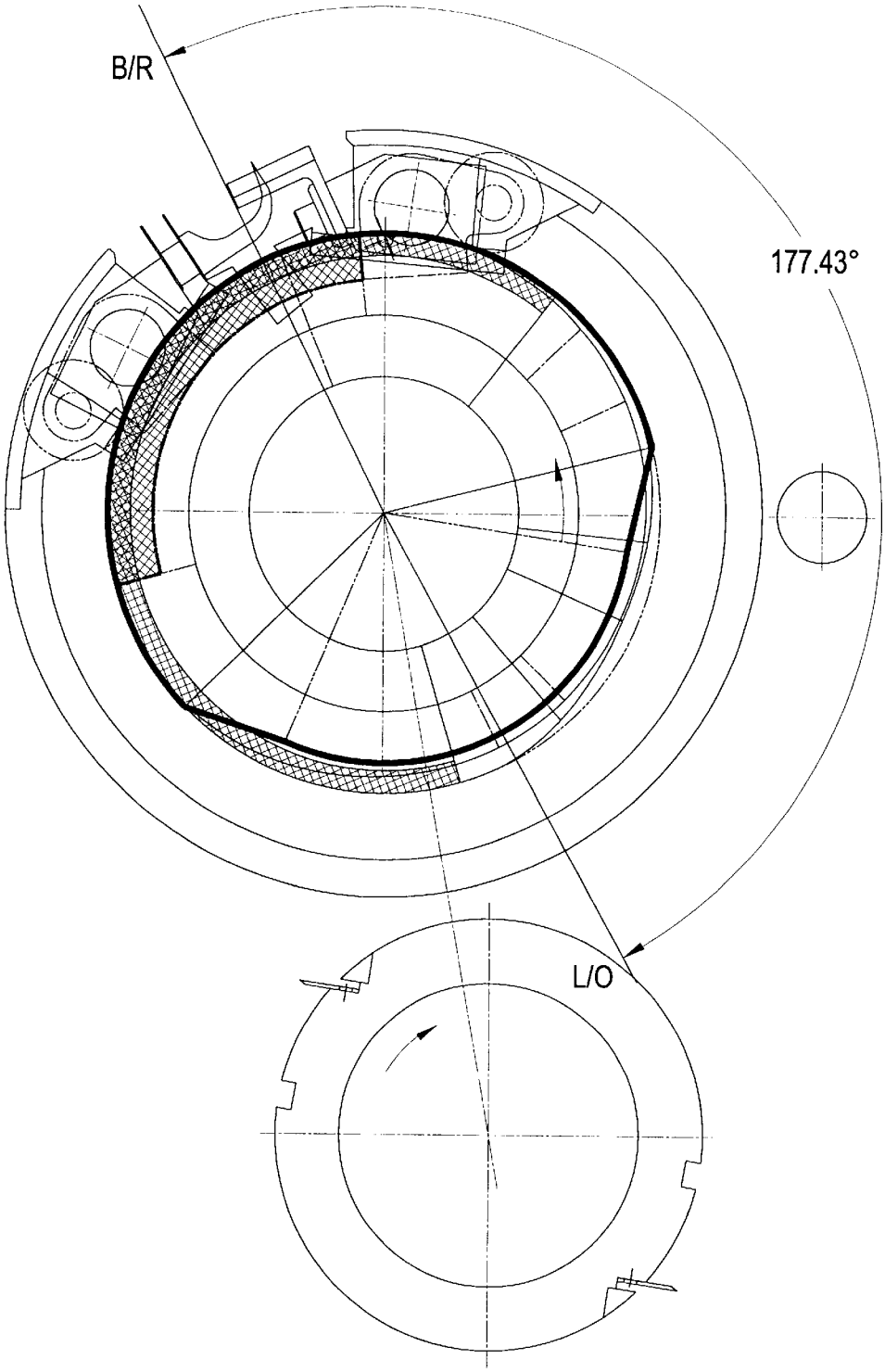
Figure 17:
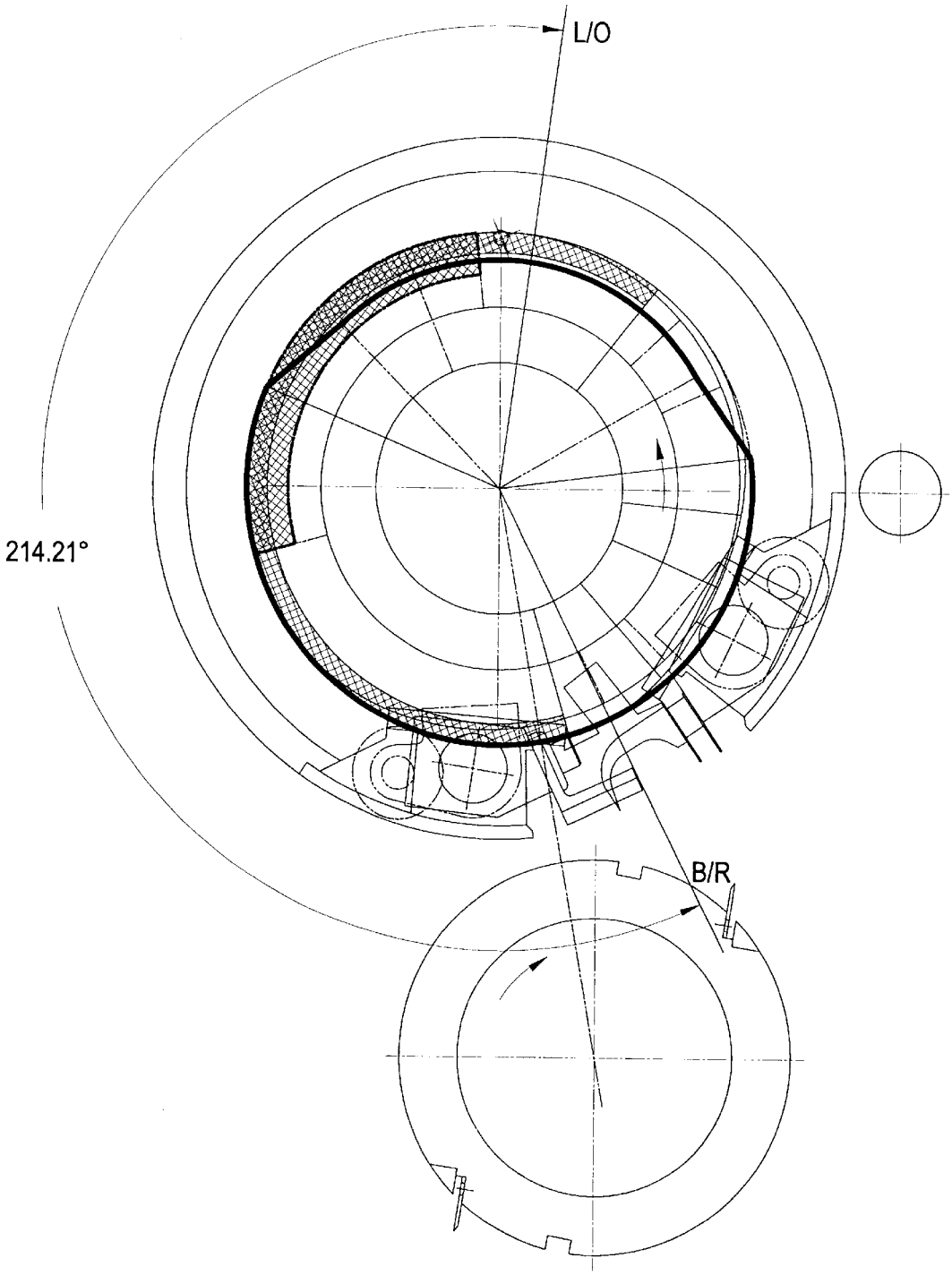

FIG. 15 illustrates the position of the bedroll one-half revolution after FIG. 14. Both of the cam followers 81 and 83 are now riding on the circular portion 87 of the lockout cam, and both of the cam followers 82 and 84 are out of engagement with the pin cam 65 and pad cam 66.

Figure 18:
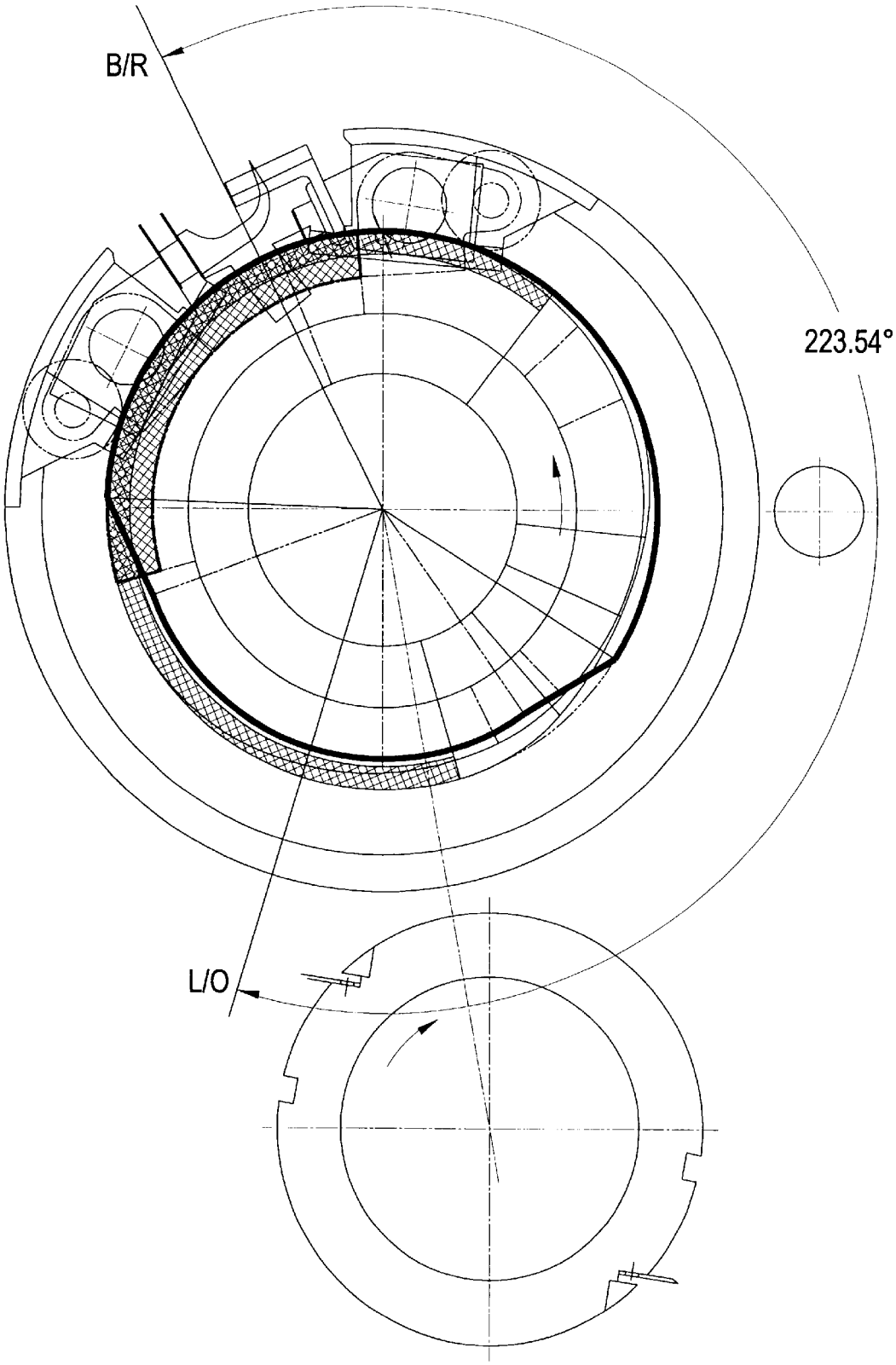

In FIG. 18 the rotational speed of the lockout cam is instantaneously matched with the rotational speed of the bedroll.

Figure 19:
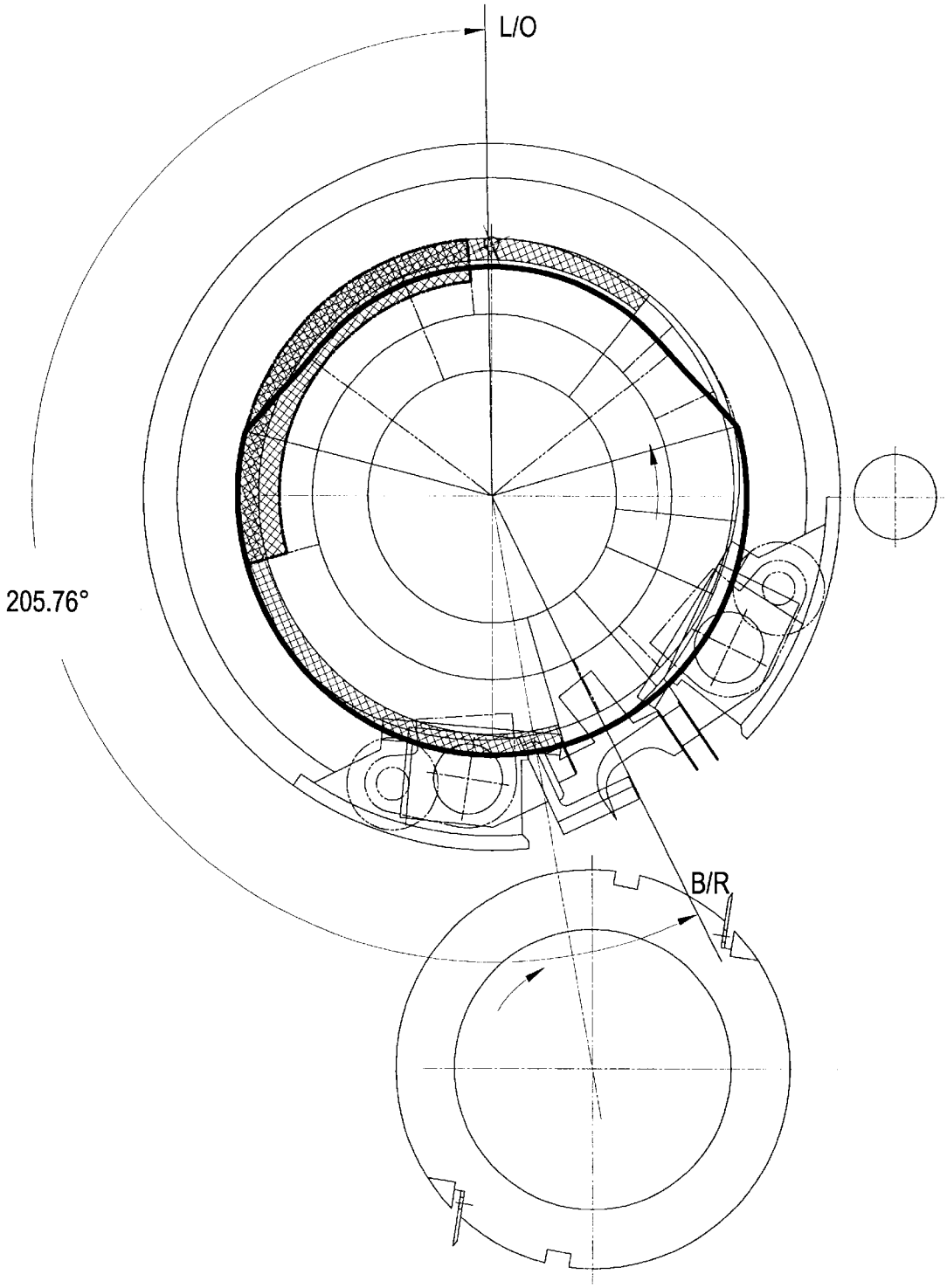

In FIG. 19 the lockout cam begins shifting forwardly relative to the bedroll with accelerating speed and begins to reset for the next transfer.

Figure 20:
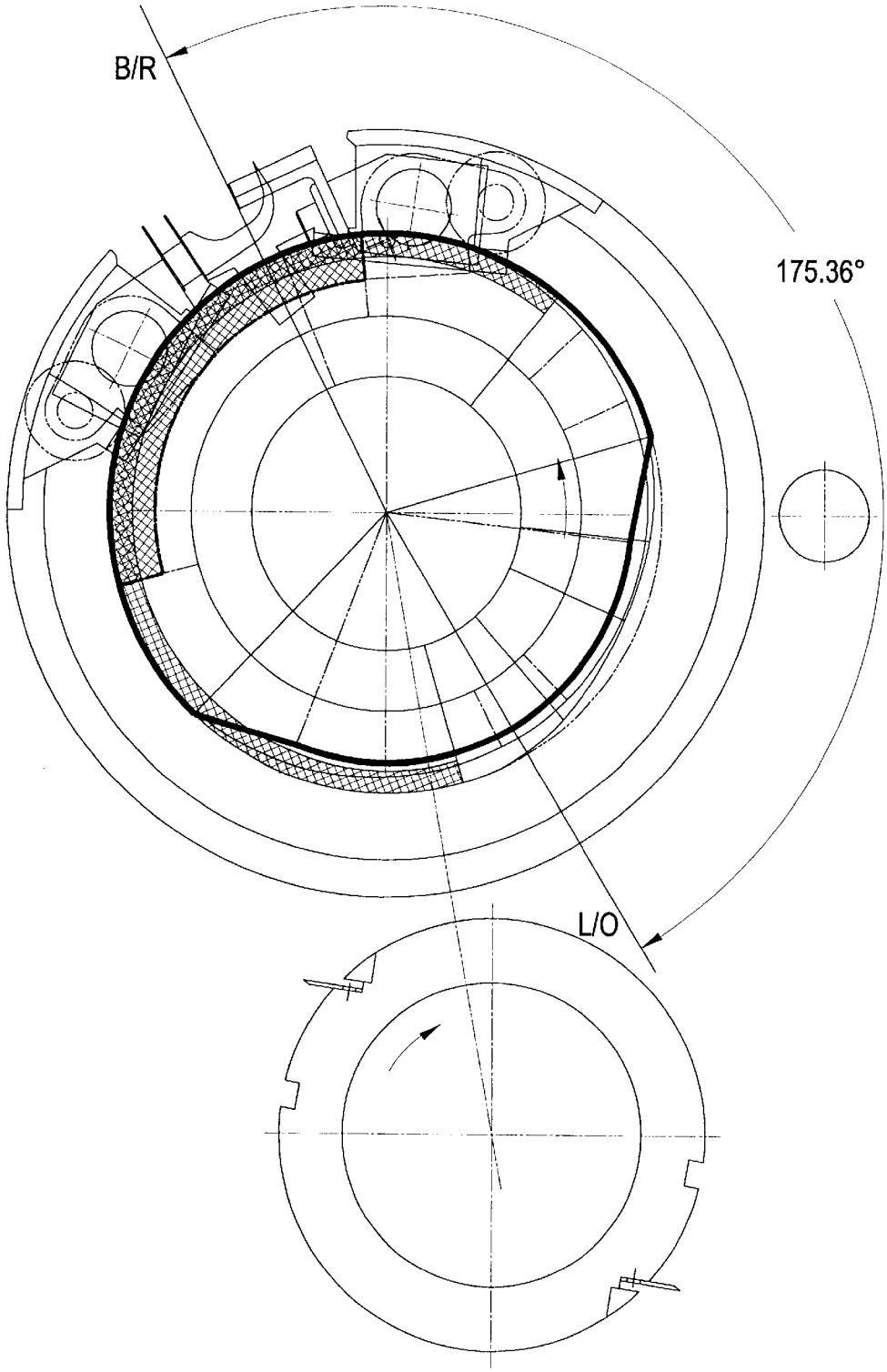
Figure 21:
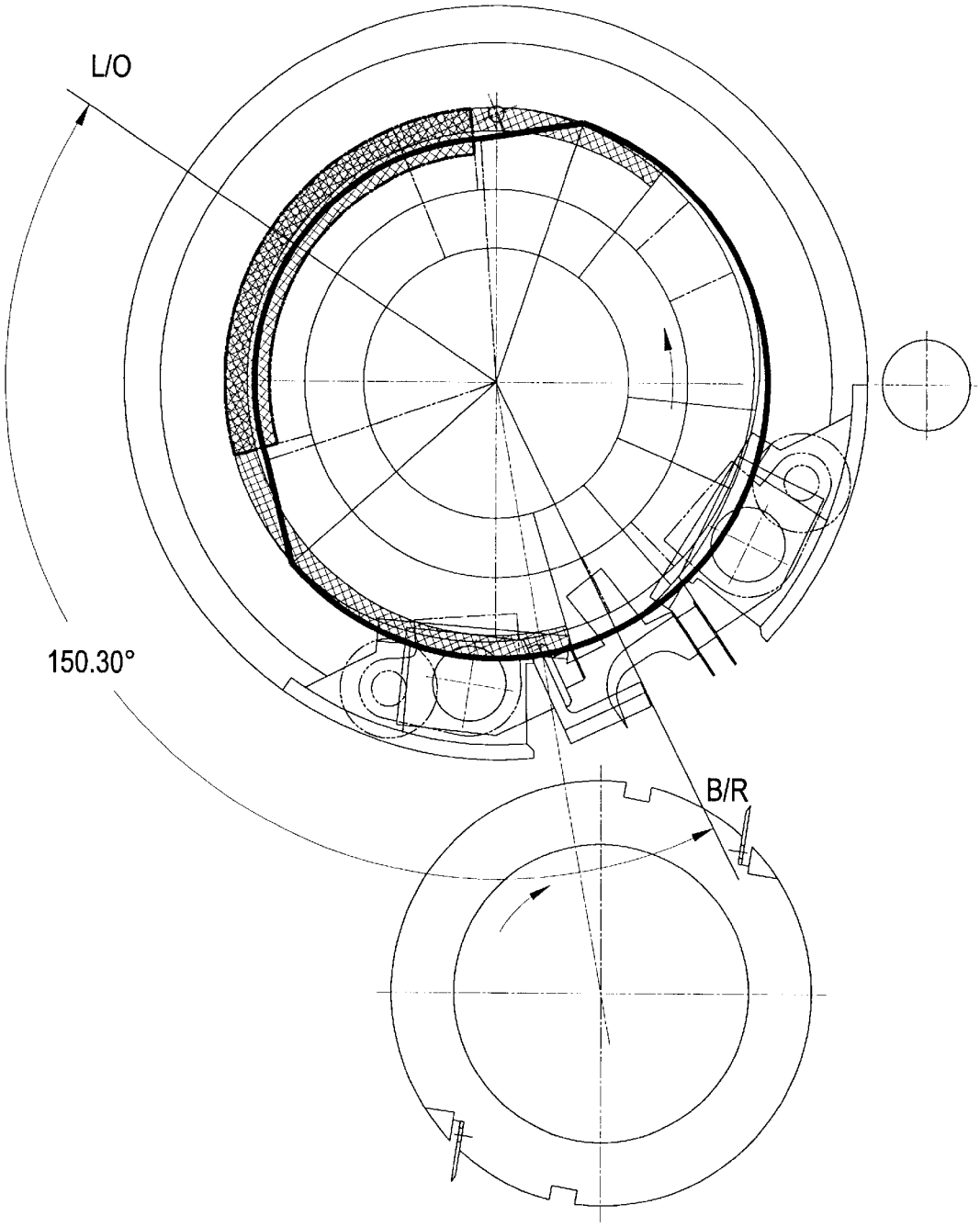
Figure 22:
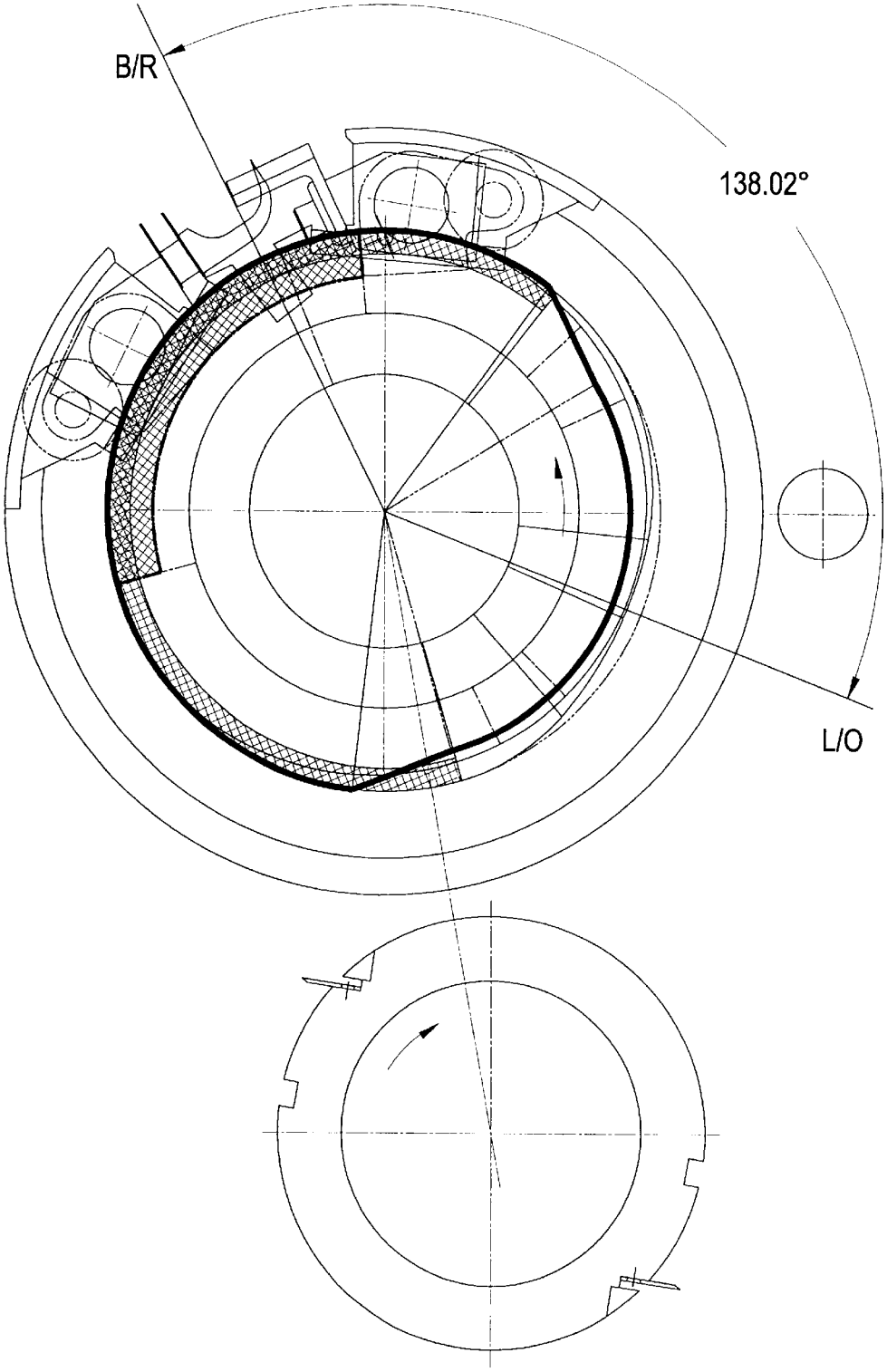

In FIGS. 20–22 the lockout cam continues to shift forwardly relative to the bedroll.

Figure 23:
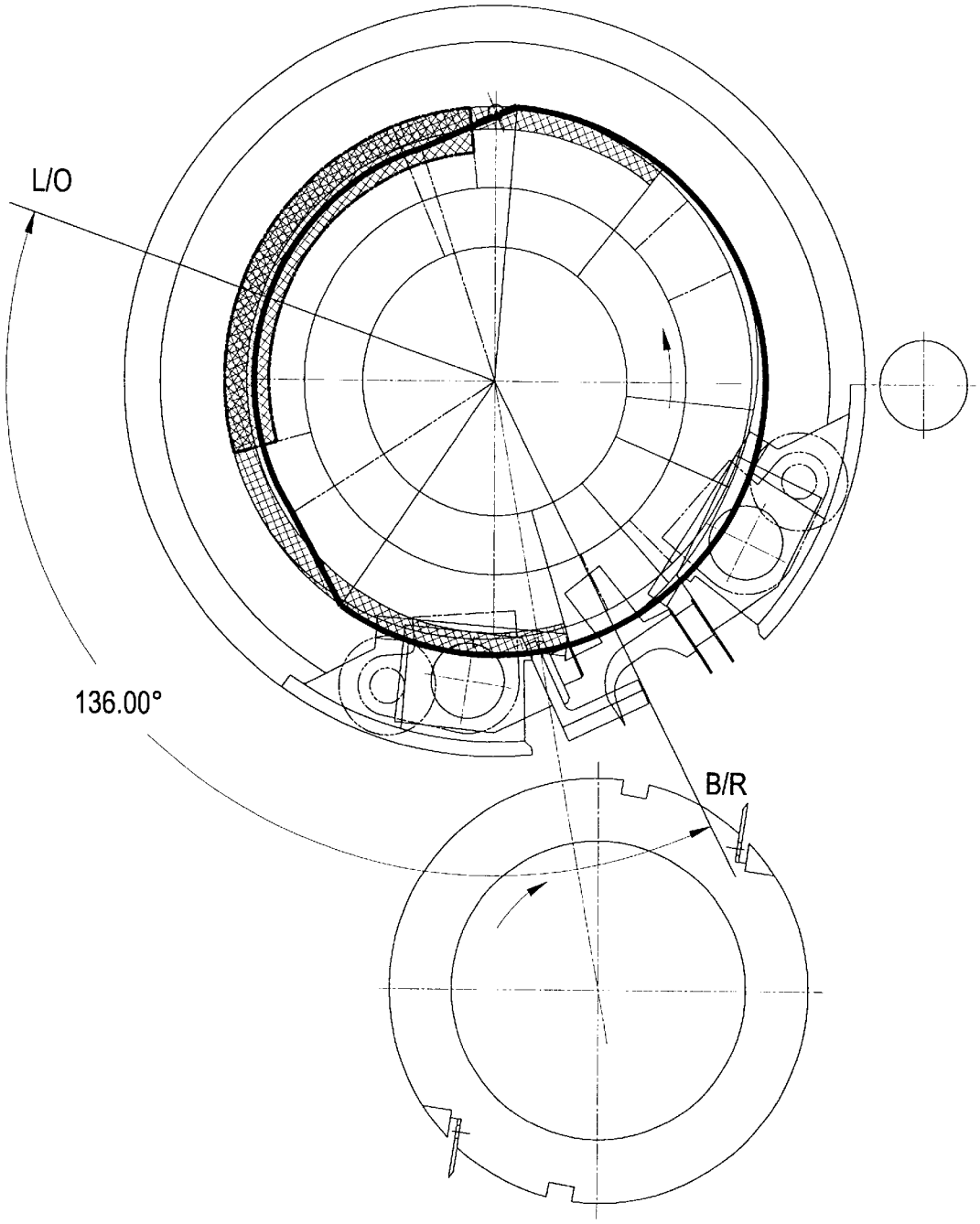

In FIG. 23 the speed of the lockout cam is matched with the speed of the bedroll. The speed of the lockout cam remains matched with the speed of the bedroll until the beginning of the next cutoff and transfer sequence which corresponds to FIG. 8.

The bedroll 32 is driven by a gear on the journal 43 (FIG. 3). The gear is driven by the servo drive system of the rewinder which is conventional and well known. The servo drive for the bedroll and the servo motor 78 can both be controlled by the same processor, for example, a PIC 900 manufactured by Giddings & Lewis.

Although the preferred rotary drive for the lockout cam is illustrated in FIG. 3, any equivalent rotary drive system can be used as long as the speed of the lockout cam can be synchronized with the speed of the bedroll during the winding operation so that the position of the lockout cam relative to the bedroll and to the cam followers can be controlled.

In the winding operation which has been described, the web is wound on cardboard cores. However, the web can also be wound on recycled mandrels which are removed from the log after the log is wound as described in U.S. Pat. No. 5,421,536.

Each of the pivot shafts 51 and 52 and their associated transfer pins or transfer pads and cam followers is a web-engaging assembly. The web-engaging assemblies are normally maintained in a position in which they do not engage the web during winding. During the cutoff and transfer cycler, two cooperating web-engaging assemblies which include transfer pins 53 and transfer pads 58 are pivoted outwardly so that the pins can hold the web during cutoff and the pads can push the leading end of the severed web onto the new core.

Figure 26:
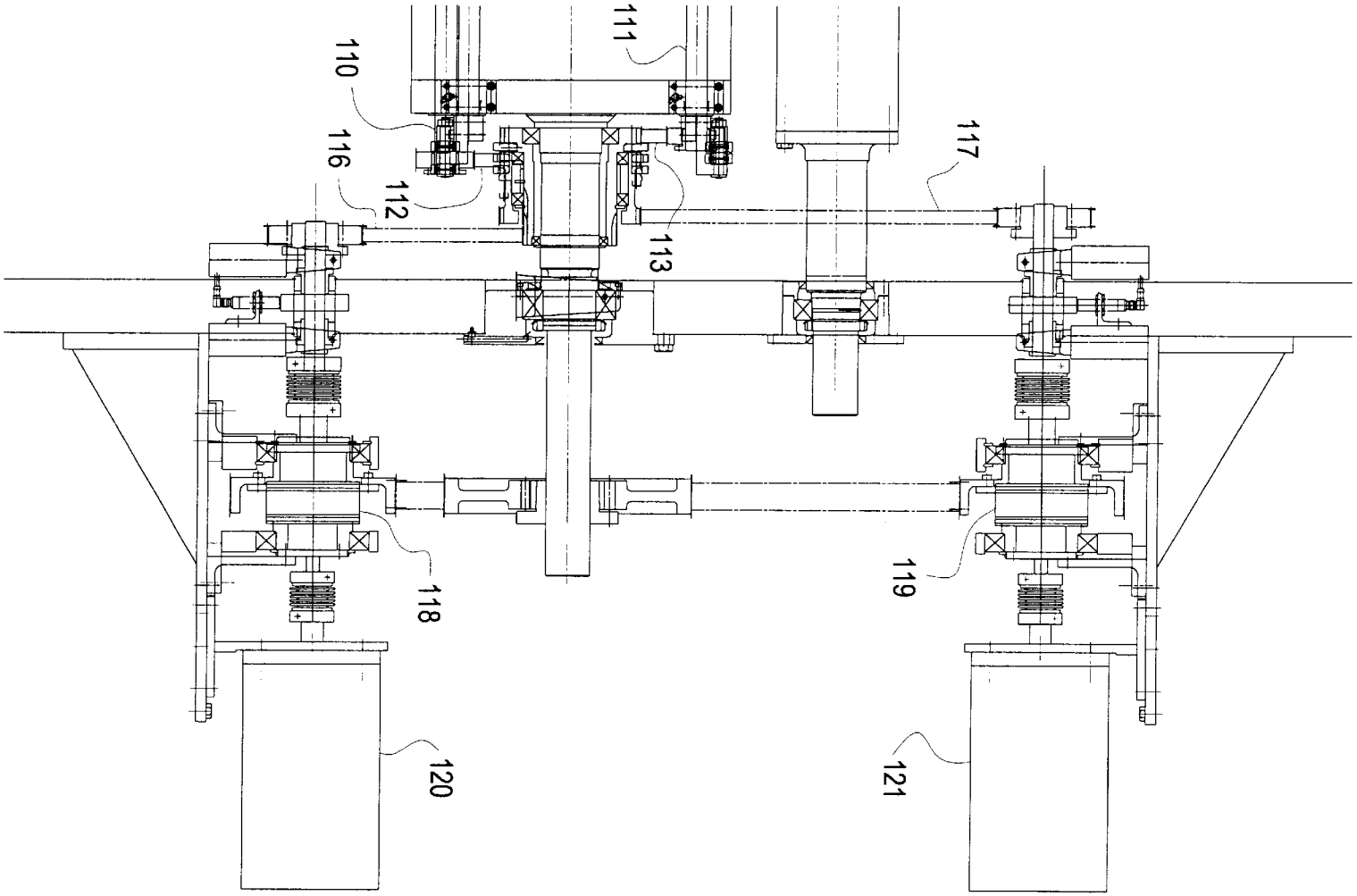
FIGS. 26 and 27 illustrate another embodiment of the invention which omits the lockout cam, pin cam, and pad cam.
Figure 27:
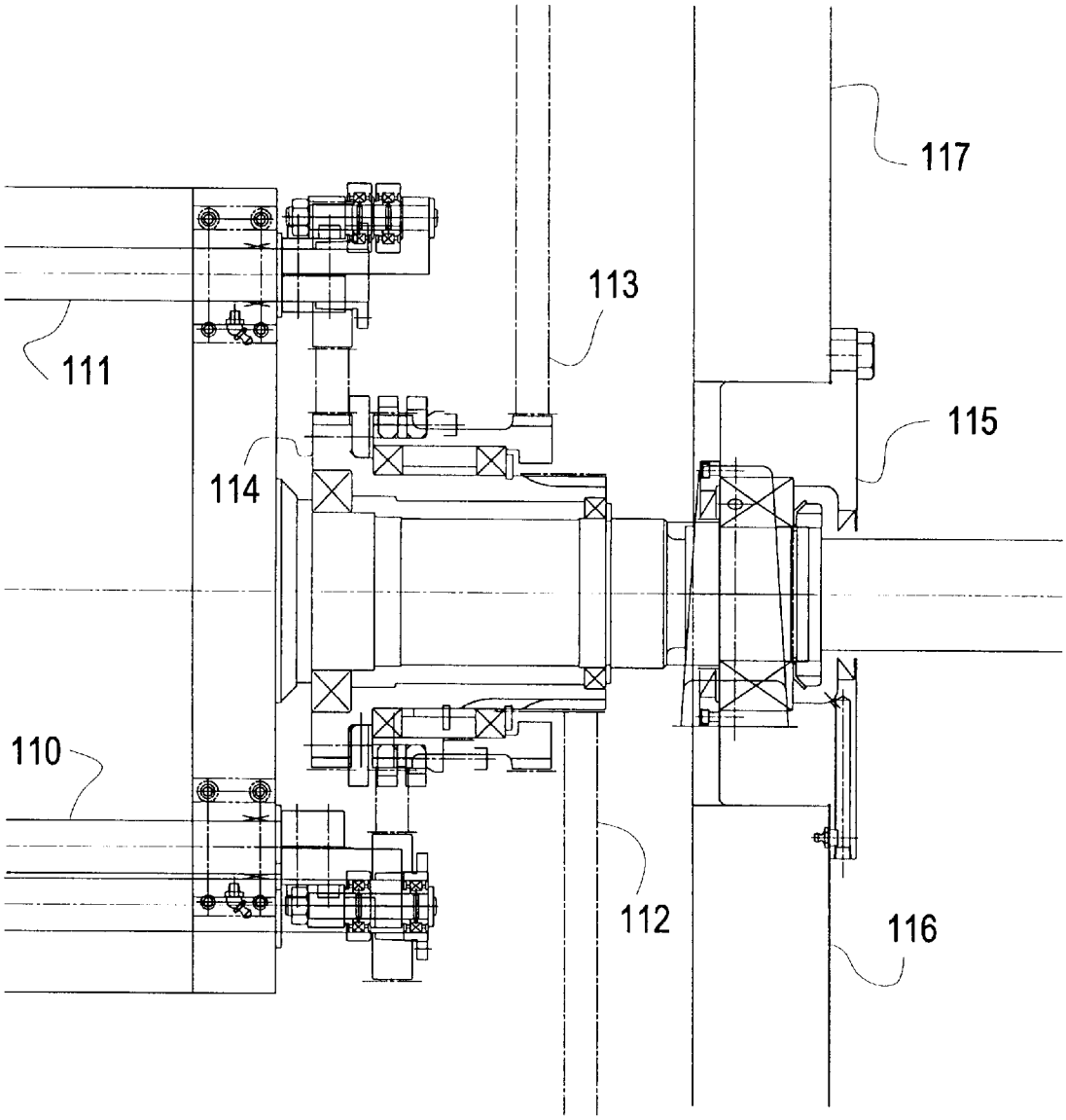

FIGS. 26 and 27 illustrate a rewinder which omits the lockout cam, pad cam, and pin cam. The pin shaft 110 and pad shaft 111 are rotatably driven by timing belts 112 and 113. The timing belt 113 is driven by hub 114 which is rotatably mounted on the bedroll journal, and the timing belt 112 is driven by a hub 115 which is mounted on the hub 114. The hubs 114 and 115 are driven through timing belts 116 and 117 by differentials 118 and 119 and electric servo motors 120 and 121 as previously described. The servos provide the additional rotational speed to rotate the pad or pin shaft relative to the bedroll.

The advantage of the design of FIGS. 26 and 27 is that no cams are required. However, the cost is higher because of the additional servo motor and differential. Also, the size of the timing pulleys does not allow the design to be used with smaller bedrolls due to space considerations.

Figure 28:
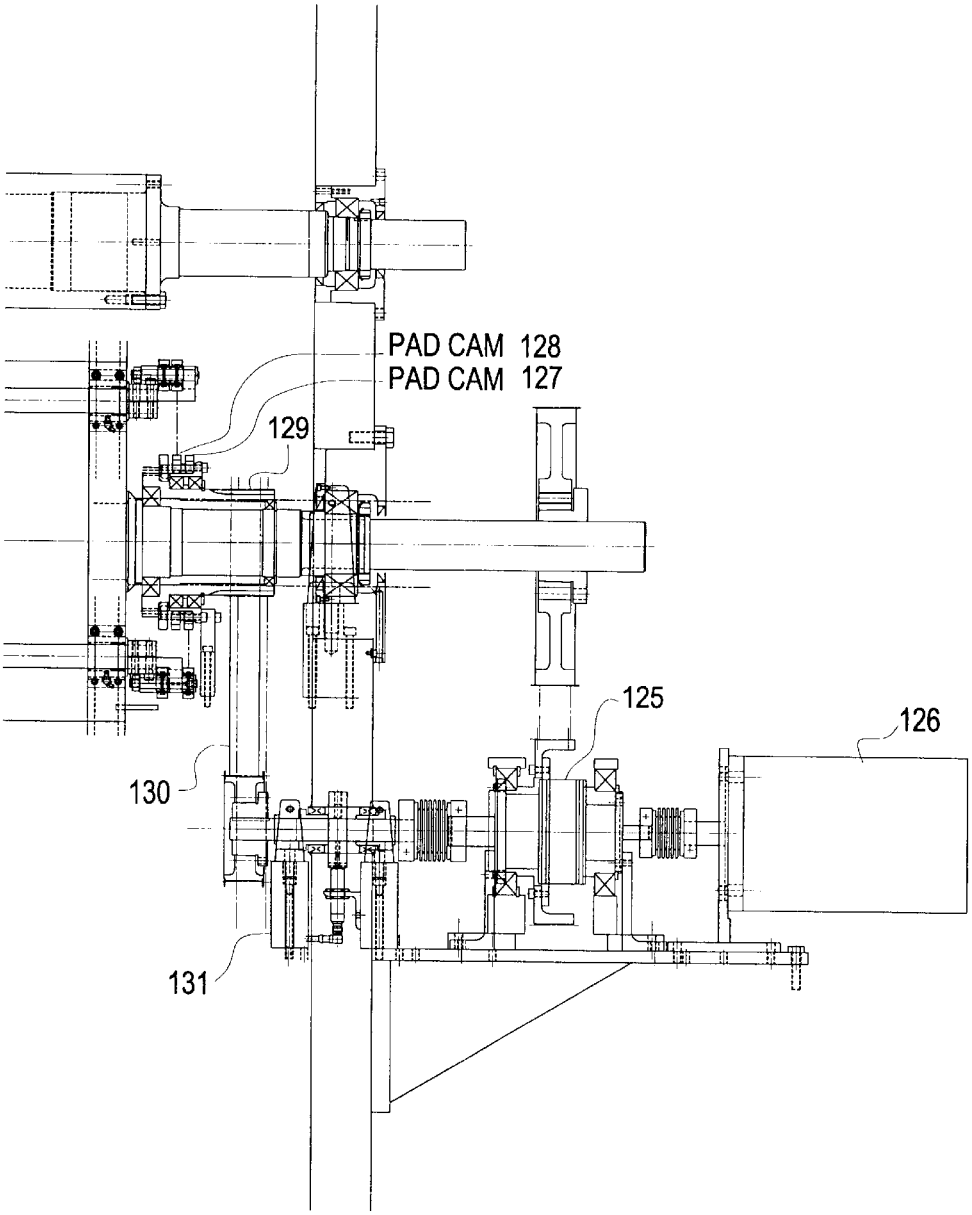
FIGS. 28 and 29 illustrate a different embodiment of the invention which omits the lockout cam.
Figure 29:
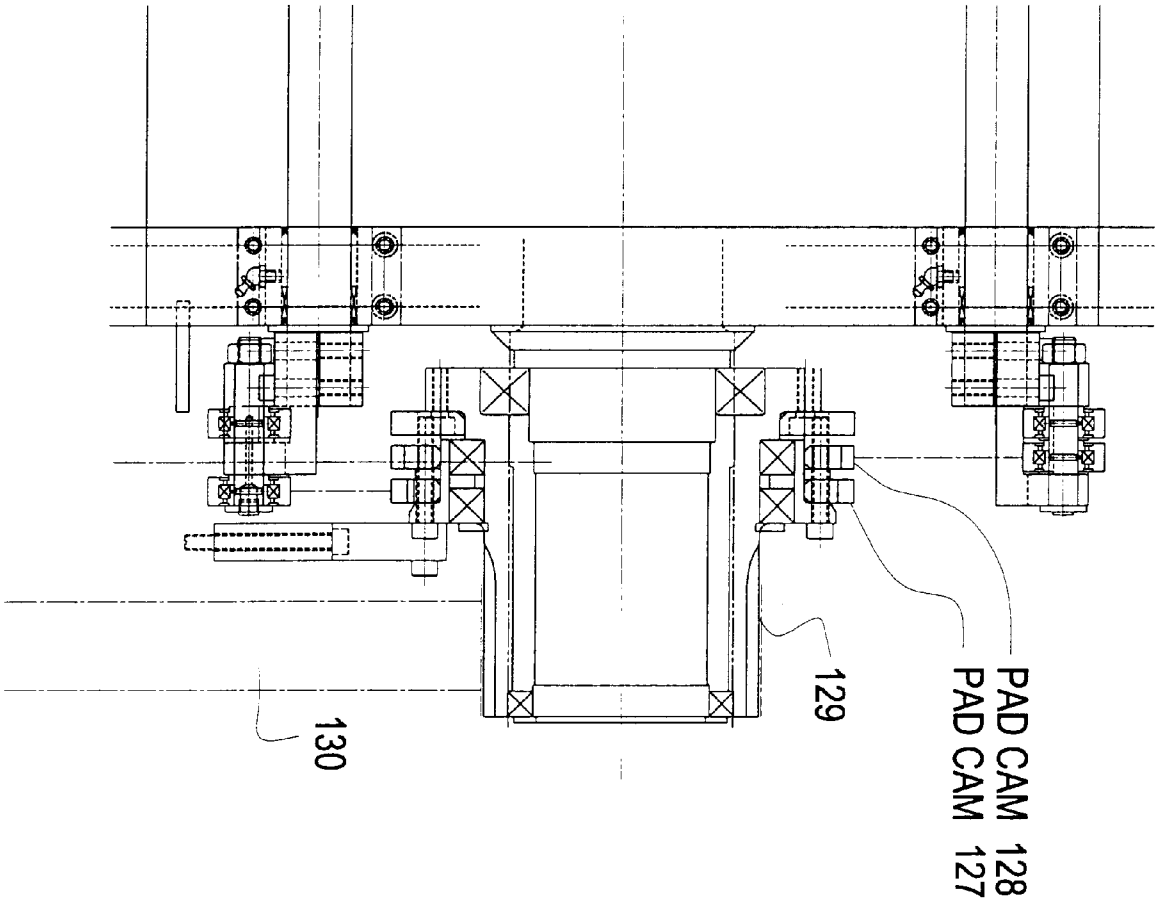

FIGS. 28 and 29 illustrate a design in which the lockout cam is omitted. The drive includes a differential 125 and an electric servo motor 126 as previously described. However, the pin cam 127 and pad cam 128 rotate with hub 129 which is rotatably mounted on the bedroll journal. The hub is rotated by timing belt 130 which is driven by pulley 131.

Normally, the cams rotate at a speed match with the bedroll during the normal wind. At the time of transfer, the cams are decelerated by the servo 126 to provide relative motion between the bedroll and the cams, thereby causing the pins and pads to actuate. The advantage of this design is no lockout cam is required, and the design is really much simpler. In addition, the motion profile does not occur over approximately 7½ bedroll revolutions (like the lockout cam does) but rather occurs in just one bedroll revolution. This means that the cycle time can be much shorter, allowing more flexibility in how often the cycle can occur. Unfortunately, this shorter cycle time also causes the torque requirements for the motor to be very high which would then necessitate either a reduction in design speed or the use of an expensive hydraulic servo motor.

While in the foregoing specification a detailed description of specific embodiments of the invention has been set forth for the purpose of illustration, it will be understood that many of the details herein given can be varied considerably by those skilled in the art without departing from the spirit and scope of the invention.

I claim:

1. An apparatus for processing a web comprising:

a frame, a roll rotatably supported on the frame for rotation about a longitudinal axis, the roll having an outer surface for contacting a web, a web-engaging assembly movably mounted on the roll and including a web-engaging member, the web-engaging member being movable between a first position in which the web-engaging member is inwardly of the outer surface of the roll and a second position in which the web-engaging member projects beyond the outer surface of the roll and is engageable with a web thereon, a stationary cam mounted on the frame, the web-engaging assembly including a cam follower assembly which is engageable with the stationary cam for moving the web-engaging member between said first and second positions, a lockout cam rotatably mounted relative to the frame and to the roll, the lockout cam having a first portion which is engageable with the cam follower assembly for preventing the cam follower assembly from contacting the stationary cam and a second portion for allowing the cam follower assembly to contact the stationary cam, and means for moving the lockout cam relative to the roll and to the cam follower assembly whereby the first portion of the lockout cam can be moved into and out of engagement with the cam follower assembly.

2. The apparatus of claim 1 in which the web-engaging member includes pins for piercing the web.

3. The apparatus of claim 1 in which the web-engaging member includes pads for pushing the web away from the outer surface of the roll.

4. The apparatus of claim 1 in which the roll includes a journal rotatably mounted on the frame, the lockout cam being rotatably mounted on the journal.

5. The apparatus of claim 4 in which the means for moving the lockout cam includes a servo motor.

6. The apparatus of claim 5 in which the lockout cam is mounted on a hub which is rotatably mounted on the journal, and drive means connecting the servo motor and the hub for rotating the hub and the lockout cam.

7. The apparatus of claim 1 in which the means for moving the lockout cam includes a differential which is drivingly connected to the roll, a shaft rotatable by the differential, and a servo for changing the speed of said shaft.

8. The apparatus of claim 7 in which the lockout cam is mounted on a hub which is rotatably mounted on the journal, and drive means connecting shaft and the hub for rotating the hub and the lockout cam.

9. The apparatus of claim 7 in which the roll includes a journal rotatably mounted on the frame, the lockout cam being rotatably mounted on the journal.

10. The apparatus of claim 8 in which the means for moving the lockout cam includes a servo motor.

11. The apparatus of claim 10 in which the lockout cam is mounted on a bushing which is rotatably mounted on the journal, and drive means connecting the servo motor and the bushing for rotating the bushing and the lockout cam.

12. An apparatus for processing a web comprising:

a frame, a roll rotatably supported on the frame for rotation about a longitudinal axis, the roll having an outer surface for contacting a web, a transfer pin assembly movably mounted on the roll and including a transfer pin and a pin cam follower assembly, the transfer pin being movable between a first position in which the transfer pin is inwardly of the outer surface of the roll and a second position in which the transfer pin projects beyond the outer surface of the roll and is engageable with a web thereon, a transfer pad assembly movably mounted on the roll and including a transfer pad and a pad cam follower assembly, the transfer pad being movable between a first position in which the transfer pad is inwardly of the outer surface of the roll and a second position in which the transfer pad projects beyond the outer surface of the roll and is engageable with a web thereon, a pin cam mounted on the frame, the pin cam follower assembly being engageable with the pin cam for moving the transfer pin between said first and second positions, a pad cam mounted on the frame, the pad cam follower assembly being engageable with the pad cam for moving the transfer pad between said first and second positions, a lockout cam rotatably mounted relative to the frame and to the roll, the lockout cam having a first portion which is engageable with the pin cam follower assembly and the pad cam follower assembly for preventing the pin cam follower assembly and the pad cam follower assembly from contacting the pin cam and the pad cam, respectively, and a second portion for allowing the pin cam follower assembly and the pad cam follower assembly to contact the pin cam and the pad cam, respectively, and means for moving the lockout cam relative to the roll and to the pin cam follower assembly and the pad cam follower assembly whereby the first portion of the lockout cam can be moved into and out of engagement with the pin cam follower assembly and the pad cam follower assembly.

13. A method of processing a web comprising the steps of:

rotatably mounting a roll having an outer surface for contacting the web and a web-engaging assembly movably mounted on the roll, the web-engaging assembly including a web-engaging member and a cam follower assembly, the web-engaging member being movable between a first position in which the web-engaging member is inwardly of the outer surface of the roll and a second position in which the web-engaging member projects beyond the outer surface of the roll and is engageable with the web thereon, providing a stationary cam, rotatably mounting a lockout cam for rotation relative to the roll, the lockout cam having a first portion which is engageable with the cam follower assembly for preventing the cam follower assembly from contacting the stationary cam and a second portion for allowing the cam follower assembly to contact the stationary cam, rotating the roll to wind the web, rotating the lockout cam at the same speed as the roll so that the first portion of the lockout cam engages the cam follower assembly and the cam follower assembly is prevented from contacting the stationary cam, and rotating the lockout cam at a different speed than the roll so that the second portion of the lockout cam is aligned with the cam follower assembly and the cam follower assembly contacts the stationary cam.

14. The method of claim 13 including the step of rotating the lockout cam at the same speed as the winding roll after the step of rotating the lockout cam at a different speed than the winding roll so that the first portion of the lockout cam is aligned with the cam follower assembly.

15. The method of claim 13 including the step of using a servo motor to rotate the lockout cam.

16. An apparatus for processing a web comprising:

a frame, a roll rotatably supported on the frame for rotation about a longitudinal axis, the roll having an outer surface for contacting a web, a pin shaft rotatably mounted on the roll and having an end extending beyond the roll, at least one pin mounted on the pin shaft for rotation with the pin shaft, a pad shaft rotatably mounted on the roll and having an end extending beyond the roll, at least one pad mounted on the pad shaft for rotation with the pad shaft, means connected to said end of the pin shaft for rotating the pin shaft relative to the roll, and means connected to said end of the pad shaft for rotating a pad shaft relative to the winding roll.

17. The apparatus of claim 16 in which said means for rotating the pin shaft includes a servo motor.

18. The apparatus of claim 16 in which said means for rotating the pin shaft includes a cam follower on said end of the pin shaft and said means for rotating the pad shaft includes a cam follower on said end of the pad shaft.

19. The apparatus of claim 16 in which the roll includes a journal rotatably mounted on the frame, said means for rotating the pin shaft including a first hub rotatably mounted on the journal, first drive means connecting said end of the pin shaft to the first hub for rotating the pin shaft with the first hub, and second drive means for rotating the first hub relative to the roll, said means for rotating the pad shaft including a second hub rotatably mounted on the journal, third drive means connecting said end of the pad shaft to the second hub for rotating the pad shaft with the second hub, and fourth drive means for rotating the second hub relative to the roll.

20. The apparatus of claim 16 in which the roll includes a journal rotatably mounted on the frame, said means for rotating the pin shaft including a cam follower on said end of the pin shaft and a pin cam rotatably mounted on the journal, said means for rotating the pad shaft including a cam follower on said end of the pad shaft and a pad cam rotatably mounted on the journal, and means for rotating the pin cam and the pad cam relative to the roll.

21. The apparatus of claim 20 including a hub rotatably mounted on the journal, said pin cam and said pad cam being mounted on said hub.

* * * * *